US005689768A

United States Patent [19]

Ehara et al.

[11] Patent Number: 5,689,768

[45] Date of Patent: Nov. 18, 1997

[54] ELECTROPHOTOGRAPHING APPARATUS FOR COLLECTING TONER FROM A PHOTOSENSITIVE MEMBER AND CONVEYING IT TO DEVELOPING MEANS

[75] Inventors: Toshiyuki Ehara, Yokohama; Koji Yamazaki, Nara; Tetsuya Karaki, Kyoto, all of Japan

[73] Assignee: Canon Kabushiki Kaisha, Tokyo, Japan

[21] Appl. No.: 568,268

[22] Filed: Dec. 6, 1995

[30] Foreign Application Priority Data

Dec. 7, 1994 [JP] Japan ..... 6-303644

[51] Int. Cl.[6] ..... G03G 5/08; G03G 15/00; G03G 21/00

[52] U.S. Cl. ..... 399/96; 399/159; 399/359; 430/66

[58] Field of Search ..... 355/297, 298, 355/211, 30; 430/57, 66, 69

[56] References Cited

U.S. PATENT DOCUMENTS

| | | | |
|---|---|---|---|
| 3,879,124 | 4/1975 | Eppe et al. | 355/298 X |
| 3,917,397 | 11/1975 | Tanaka et al. | 355/297 |
| 4,265,991 | 5/1981 | Hirai et al. | 430/64 |
| 4,721,663 | 1/1988 | Johncock et al. | 430/66 X |
| 4,755,853 | 7/1988 | Shimizu et al. | 355/298 |
| 4,939,057 | 7/1990 | Honda et al. | 430/69 |
| 5,289,249 | 2/1994 | Yamamoto et al. | 355/298 |
| 5,400,127 | 3/1995 | Arai et al. | 355/298 |
| 5,442,430 | 8/1995 | Ishii et al. | 355/298 |
| 5,561,021 | 10/1996 | Yamazaki et al. | 430/66 X |

*Primary Examiner*—Shuk Lee
*Assistant Examiner*—Sophia S. Chen
*Attorney, Agent, or Firm*—Fitzpatrick, Cella, Harper & Scinto

[57] ABSTRACT

An electrophotographing apparatus with a reusable toner system includes a photosensitive member capable of bearing toner thereon, a latent image forming unit for forming a latent image on the photosensitive member, a developing unit for developing the latent image with toner as a toner image, a transfer unit for transferring the toner image formed on the photosensitive member onto a transfer material at a transfer position, and a collection unit for collecting the toner from a surface of the photosensitive member after the surface passes through the transfer position. The collection unit includes a rotary member rotated while contacting the surface of the photosensitive member at a contact position. The rotary member is rotated in a direction opposite to a shifting direction of the photosensitive member at the contact position in such a manner that the relative speed of the rotary member with respect to the surface of the photosensitive member at the contact position becomes 110% or more of a shifting speed of the surface of the photosensitive member. The apparatus also includes a toner convey unit for conveying the toner collected by the collection unit to the developing unit so that the latent image formed on the photosensitive member can be developed by the toner collected by the collection unit.

18 Claims, 12 Drawing Sheets

ELECTROPHOTOGRAPHING APPARATUS FOR COLLECTING TONER FROM A PHOTOSENSITIVE MEMBER AND CONVEYING IT TO DEVELOPING MEANS

BACKGROUND OF THE INVENTION

1. Field of the Invention

The present invention relates to an electrophotographing apparatus such as a copying machine, a printer and the like in which image formation is effected by transferring a toner image formed on a photosensitive member onto a transfer material.

2. Related Background Art

In the past, many electrophotographing methods are well known, as disclosed in U.S. Pat. No. 2,297,692, Japanese Patent Publication No. 42-23910 (1967) and Japanese Patent Publication No. 43-24748 (1968). In general, an electrical latent image is formed on a photosensitive member by various methods with the use of photo-conductive material, and, then, the latent image is developed and visualized with toner as a toner image. After the toner image was transferred on a transfer material such as a paper sheet, the toner image is fixed to the transfer material by heat, pressure, heat/pressure, vaporization of solvent or the like, thereby obtaining a copy. In the above processes, even after the toner image was transferred on the transfer material, since non-transferred toner is still remaining on the photosensitive member, the non-transferred toner was conventionally collected by means of a cleaning process and was discharged out of the apparatus as waste toner.

However, recently, as the information processing amount has been greatly increased, electrophotographing apparatuses such as copying machines, laser beam printers and the like having large copy volume (i.e. large and high speed machines) have strongly been requested. In such high speed machines, since a large amount of waste toner is generated, the re-use of the waste toner has recently been investigated. If the waste toner can be re-used, it is possible to not only use the toner effectively but also simplify any space within the apparatus to make the apparatus more compact.

In electrophotographing apparatuses of this kind, the improvement in function for permitting the use of the apparatus within a field where an environmental condition is greatly changed (more specifically, the improvement in function wherein so-called "high humidity image flow" is hard to be caused even if the dewing is generated under a high humidity condition or due to abrupt change in temperature) has been requested. To achieve this, conventionally, a moisture removing heater was disposed within the photosensitive member of the electrophotographing apparatus to heat the photosensitive member to a temperature of about 40° C.

However, when the waste toner collected by the cleaning process is re-used, it is considered that there arises a problem that the toner is fused on the photosensitive member. This is caused because, as the collection and re-use of the toner is repeated, the amount of paper powder which penetrates into the toner and/or additive agent included in the toner to obtain the polishing effect is gradually decreased.

Further, if the additive agent is decreased during the collection and re-use cycle, a ratio between the toner particles and the additive agent is changed, with the result that there arises a problem that it is impossible to maintain the tribo of the toner itself within a predetermined range. To avoid this, it is considered that the components of the toner particle itself is appropriately selected to maintain the tribo of the toner itself within the predetermined range without adding the additive agent. However, if the toner having no additive agent is used, the toner is apt to be fused on the photosensitive member.

Accordingly, when the toner is collected and re-used, it is necessary to decrease the temperature of the photosensitive member as much as possible, thereby minimizing the danger of fusing the toner.

Further, in the recent techniques in which finer image quality is required, the size of the toner particle is made smaller. Thus, although toner having weight average particle diameter of 0.004 to 0.011 mm measured by a Colter counter is usually used, this effects a bad influence upon the fusing of the toner.

Further, the reduction of power consumption has also been requested from the view point of ecology. More specifically, the omission of the moisture removing heater or reduction of power consumption has been requested. Although the moisture removing heater has a normal capacity of about 15 to 80 W, and, thus, it does not seem to be a large electric power amount, since the moisture removing heater is usually being energized all the day including at night, the power consumption amount of the heater reaches 5 to 15% of the power consumption amount of the entire electrophotographing apparatus a day.

Further, there is an economical requirement, and an electrophotographing apparatus which provides high quality, high reliability, high productivity and high efficiency and which is cheaper has been requested. More specifically, it has been requested that the stopping distance (time) for maintenance should be reduced and the apparatus can be used immediately after a power switch is turned ON.

Electrophotographic photosensitive members which have recently been used have hard surfaces to increase the number of copies, with the result that the surface of the photosensitive member becomes more sensitive to humidity (easy to absorb moisture) due to the influence of corona products from a charger generated by the repeated use of the apparatus. Thereby easily causing drift of charge on the surface of the photosensitive member, which results in the reduction of the image quality referred to as "image flow".

To prevent the image flow, a method for heating a photosensitive member by means of a heater as disclosed in the Japanese Utility Model Publication No. 1-34205 (1989), a method for removing corona products by frictionally rubbing a surface of a photosensitive member by a brush comprised of a magnet roller and magnetic toner as disclosed in the Japanese Patent Publication No. 2-38956 and a method for removing corona products by frictionally rubbing a surface of a photosensitive member by an elastic roller as disclosed in the Japanese Patent Application Laid-open No. 61-100780 have been proposed. However, the methods for frictionally rubbing the surface of the photosensitive member decreases the number of possible copies, except for very hard amorphous silicon photosensitive members, and the method for heating the photosensitive member by means of the heater increases the power consumption as mentioned above.

It is not known to heat a photosensitive member by means of an external heater similar to the present invention. For example, the Japanese Patent Application Laid-open Nos. 59-111179 and 62-278577 do not disclose the improvement in image density factors of a photosensitive member unstable to temperature change. Under these circumstances, a new moisture removing device as an environment stabilizing system for an electrophotographing apparatus and an electrophotographic image forming method have been requested.

FIG. 1 schematically shows an example of an image forming process of a copying machine. In FIG. 1, around a photosensitive member 101 (a temperature of which is controlled by an inner surface heater 123) rotated in a direction shown by the arrow X, there are disposed a main charger 102, an electrostatic latent image forming portion 103, a developing device 104, a transfer sheet supply system 105, a transfer charger 106*a*, a separation charger 106*b*, a cleaner 107, a convey system 108, an electricity removal light source 109 and the like.

Explaining the image forming process with reference to the illustrated example, the photosensitive member 101 is uniformly charged by the main charger 102 to which high voltage of +6 to 8 KV is applied. In the image forming portion 103, light emitted from a lamp 110 is reflected by an original 112 rested on an original support glass 111, and the reflected light is incident to the photosensitive member 101 through mirrors 113, 114, 115, a focusing lens 118 of a lens unit 117 and a mirror 116, thereby forming an electrostatic latent image on the photosensitive member 101. Toner having negative polarity is supplied from the developing device 104 to the latent image, thereby visualizing the latent image as a toner image.

On the other hand, a tip end timing of a transfer material P supplied from the transfer sheet supply system 105 is adjusted by a pair of regist rollers 122. Then, the transfer material is introduced between the photosensitive member 101 and the transfer charger 106*a* to which high voltage of +7 to 8 KV is applied, where positive electric field having polarity opposite to that of the toner is applied to a back surface of the transfer material, thereby transferring the negative toner image formed on the surface of the photosensitive member 101 onto the transfer material P. Then, the transfer material is separated from the photosensitive member by means of the separation charger 106*b* to which high AC voltage having 12 to 14 KVp-p and 300 to 600 Hz is applied, and the separated transfer material P is sent, through the convey system 108, to a fixing device (not shown), where the toner image is fixed to the transfer material P. Thereafter, the transfer material is discharged out of the copying machine. The toner remaining on the photosensitive member 101 is scraped off from the photosensitive member by a cleaning blade 121 of the cleaner 107, and the electrostatic latent image remaining on the photosensitive member 101 is erased by the electricity removal light source 109.

[Organic Photo-Conductor (OPC)]

As photo-conductive material for the electrophotographic photosensitive member 101, various organic photoconductors have recently been developed, and, in particular, a laminated photosensitive member comprised of a charge generating layer and a charge transfer layer is already put in practical use and is mounted within copying machines and laser beam printers.

However, it was considered that such photosensitive members generally have a significant drawback (i.e. low durability). The durability is grouped into electrophotographic physical durability such as sensitivity, residual potential, charging ability and image blur and mechanical durability such as wear and/or scratch on the surface of the photosensitive member due to the rubbing action, both of which are significant factors for determining the service life of the photosensitive member. Among them, regarding the electrophotographic physical durability (particularly, image blur), it is known that the image blur occurs due to the deterioration of charge transfer material included in the surface layer of the photosensitive member caused by active substances such as ozone, NOx or the like generated by the corona charger.

Further, regarding the mechanical durability, it is known that the wear and/or scratch occurs due to the physical sliding contact between the photosensitive layer and the paper sheet, cleaning member (blade or roller) or toner.

In order to increase the electrophotographic physical durability, it is important to use a charge transfer material which is hard to be deteriorated by active substances such as ozone, NOx or the like, and it is known to select charge transfer material having high acidic potential. Further, in order to increase the mechanical durability, it is important to reduce the friction by increasing the smoothness of the surface to resist against the rubbing action, and to improve the mold releasing ability of the surface to prevent the filming fusing of the toner, and it is known to add lubricants such as fluororesin powder, graphite fluoride, polyolefin resin powder and the like to the surface layer.

However, when the wear is considerably increased, moisture absorbing material generated by the active substances such as ozone, NOx or the like are accumulated on the surface of the photosensitive member, with the result that the surface resistance is decreased and the surface charge drifts laterally, thereby causing the so-called "image flow".

[Amorphous silicon photosensitive member (a—Si)]

In electrophotography, the photo-conductive material for forming the photosensitive layer of the photosensitive member is requested that it has high SN ratio (photo-current(Ip) /dark-current(Id)) with high sensitivity and has absorption spectrum matched with spectrum property of illuminated electromagnetic wave, that it has quick response and a desired dark resistance value, and that it is not harmful to the human body when it is used. In particular, when the electrophotographic photosensitive member incorporated into the electrophotographing apparatus used in an office as an office equipment, it is very important that the photosensitive member is not harmful.

One of the excellent photo-conductive materials is amorphous silicon hydride (referred to as "a—Si:H" hereinafter), and, for example, the Japanese Patent Publication No. 60-35059 discloses the fact that a—Si:H is applied to the electrophotographic photosensitive member.

Such an electrophotographic photosensitive member is generally formed by heating a conductive support to a temperature of 50° to 400° C. and by forming a photoconductive layer comprised of a—Si on the conductive support by means of a vacuum depositing method, a spattering method, an ion plating method, a thermal CVD method, an optical CVD method, a plasma CVD method or the like. Among these methods, the plasma CVD method (wherein raw material gas is decomposed by glow discharge using direct current, high-frequency wave or micro wave, thereby forming a—Si deposit layer on the support) is preferable and is put to practical use.

Further, in the Japanese Patent Application Laid-open No. 54-83746 (1979), an electrophotographic photosensitive member having a conductive support and an a—Si photoconductive layer including halogen atoms as one of the components is proposed. This document teaches the fact that electrical and optical property (feature) having high heat resistance and suitable as a photo-conductive layer of an electrophotographic photosensitive member can be obtained by adding the halogen atoms to a—Si by an amount of 1 to 40 atomic %.

Further, the Japanese Patent Application Laid-open No. 57-11556 (1982) disclosed a technique in which, in order to improve electrical, optical and photo-conductive features such as a dark resistance value, optical sensitivity, optical response and the like, environmental features such as anti-humidity and the like, and stability regardless of time elapse, a surface shield layer made of non-photo-conductive amorphous material including silicon atoms and carbon atoms is formed on a photo-conductive layer made of amorphous material based on silicon atoms.

Further, the Japanese Patent Application Laid-open No. 60-67951 (1985) discloses a photosensitive member having a non-light-permeable overcoat layer including amorphous silicon, carbon, oxygen and fluorine, and the Japanese Patent Application Laid-open No. 62-168161 (1987) discloses a technique in which noncrystal material including silicon atoms, carbon atoms and hydrogen having 41 to 70 atomic % is used as a surface layer.

In addition, the Japanese Patent Application Laid-open No. 57-158650 (1982) discloses a technique in which an electrophotographic photosensitive member having high sensitivity and high resistance can be obtained by providing a photo-conductive layer made of a—Si:H including hydrogen of 10 to 40 atomic % and having an absorption coefficient ratio (of absorption peak (of 2100 $cm^{-1}$ and 2000 $cm^{-1}$) of infrared absorption spectrum) of 0.2 to 1.7 on a photo-conductive layer.

On the other hand, the Japanese Patent Application Laid-open No. 60-95551 (1985) discloses a technique in which, in order to improve image quality of an image formed by an amorphous silicon photosensitive member, the reduction in surface resistance of a surface of the photosensitive member due to moisture absorption and the image flow caused by such reduced surface resistance can be prevented by performing image forming processes such as charging, exposure and development while maintaining a temperature in the proximity of the surface of the photosensitive member to 30° to 40° C. By these techniques, the optical and photo-conductive features and the environmental features are improved and the image quality is also improved accordingly.

As mentioned above, when the service life of the photosensitive member is desired to be increased by using any photo-conductive material, it is necessary to heat the photosensitive member under the high humidity condition.

On the other hand the re-use of waste toner must be done in consideration of recent tendency in the art. However, the increase in temperature of the photosensitive member by heating the latter must be avoided from the viewpoint of the fusing of toner in the toner re-using system, the electric power required for heating the photosensitive member must be reduced from the viewpoint of protection of resources and the saving of energy, and the continuous energization of the heater all night must be avoided from the viewpoint of security and reliability. Further, the social requirement for performing the removal of moisture from the photosensitive member efficiently and quickly is wanted.

In the past, the heater of the photosensitive member was energized all night when the copying machine was not used, so that the ozone products generated by the corona discharge of the charger is prevented from adhering to the surface of the photosensitive member, thereby preventing the image flow. However, when the copying machine is disenergized all night to save the resources and reduce power consumption, if the copying machine is continuously used in the daytime, the temperature around the photosensitive member within the copying machine is gradually increased, with the result that the charging ability (depending upon the temperature) and surface potential of the photosensitive member are changed, thereby changing the image density during the copying operation. Accordingly, in designing the electrophotographing apparatus having the toner re-using system and the electrophotographic image forming method, it is requested that the electrophotographic features and the mechanical durability of the electrophotographic photosensitive member are improved and at the same time the moisture removing apparatus and method are further improved in order to eliminate the above-mentioned drawbacks.

SUMMARY OF THE INVENTION

An object of the present invention is to prevent toner from adhering to a photosensitive member.

Another object of the present invention is to prevent toner from adhering to a photosensitive member in an electrophotographing apparatus wherein residual toner remaining on the photosensitive member is collected and a toner image can be formed on the photosensitive member by using the collected toner.

A further object of the present invention is to provide an electrophotographing apparatus which can remove moisture efficiently without increasing one temperature of a photosensitive member excessively and can form a high quality image having no image flow without adhering toner to a surface of the photosensitive member.

A still further object of the present invention is to provide an electrophotographing apparatus which can suppress the transfer of heat to portions that should not be heated by strictly performing heat input/output control and eliminating pitch unevenness due to thermal eccentricity of a developing sleeve and poor cleaning due to blocking of waste toner during a cleaning operation.

A further object of the present invention is to provide an electrophotographing apparatus which can save energy by effecting increase/decrease in humidity only regarding desired portions by using unique heat transfer mechanism from a heating body.

A still further object of the present invention is to provide an electrophotographing apparatus which can be made cheaper by omitting an electric power supplying mechanism such as a slip ring and the like which was conventionally required for installing a heat source within a photosensitive member.

The other objects and features of the present invention will be apparent from the following detailed explanation referring to the accompanying drawings.

DETAILED DESCRIPTION OF THE PREFERRED EMBODIMENTS

[Heat body and electrophotographing apparatus]

A heater used in the present invention requires the following five features. That is, firstly, it should have a high temperature increasing speed, secondly, it should have great output, thirdly, it should have orientation regarding heat transfer and heat discharge, fourthly, it is compact and thin-type and has high mechanical accuracy, and, lastly, it is cheap.

More specifically, such a heater is formed by providing electrical heat-resistance bodies such as nichrome wires on an elongated plate-shaped substrate made of alumina ceramics and the like. More preferably, such a heater is formed by providing an electric heat generating body made of metal (for example, silver/palladium alloy) and having an elongated heat generating portions and wider terminal end portions on a surface of an elongated plate-shaped substrate made of alumina ceramics and by coating a surface of the heat generating portion with a glass protection layer. Hereinafter, such a heater is referred to as "ceramic heater".

Figure 9A:
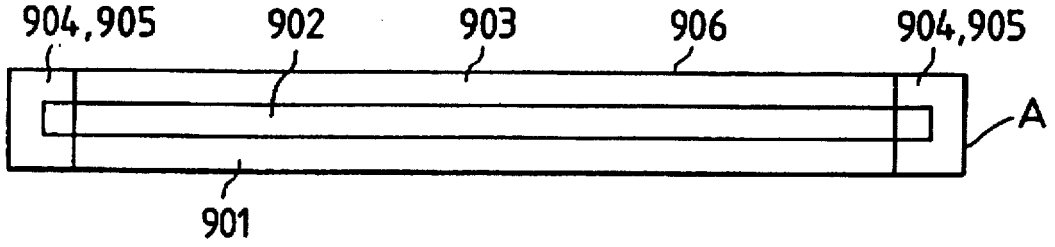
FIGS. 9A to 9D are schematic views of a ceramic heater and a nichrome heater as a heat source.
Figure 9B:
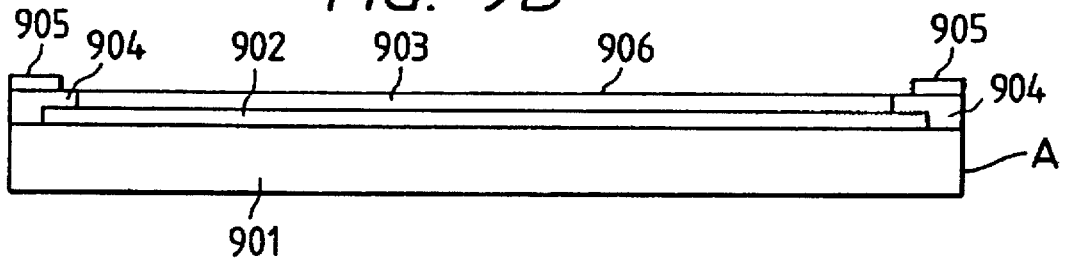

Now, the heat generating body will be fully explained with reference to FIGS. 9A to 9D. FIG. 9A is a plan view of the ceramic heat generating body (referred to as "outer surface heater A" hereinafter), and FIG. 9B is an elevational sectional view of the outer surface heater A.

The outer surface heater A comprises a substrate 901, an electric heat generating body 902 provided on the substrate 901, and a protection layer 903. The substrate 901 comprises an elongated flat plate made of mullite ceramics and having a length of 360 mm, a width of 8 mm and a height of 1 to 2 mm. The mullite ceramics has a chemical composition comprised of $Al_2O_3.2SiO_2$ and a middle feature of ceramics/glass which has heat conductivity smaller than that of the ceramics by ½ and sufficient mechanical strength and which is easy to work. The electric heat generating body 902 is formed, for example, by print-baking silver/palladium alloy powder on the substrate 901 and has an elongated central portion 906. Terminal portions 904 are formed on both ends of the central portion 906, conductive film sheets 905 (for example, made of silver) are formed on the terminal portions, and a surface of the heat generating portion 906 is coated by a glass protection layer.

Figure 9C:
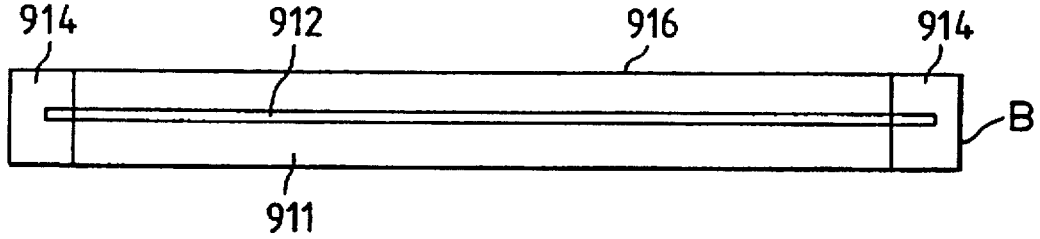
Figure 9D:
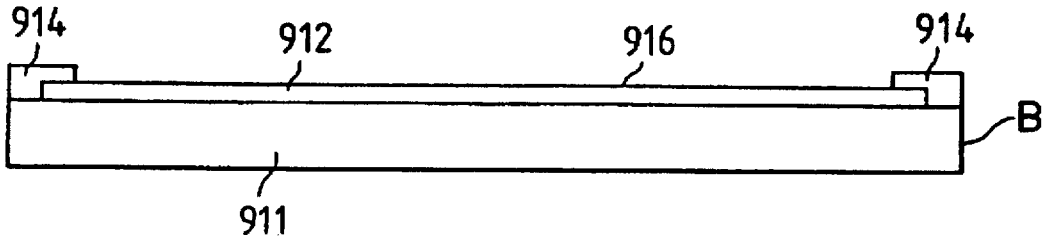

FIG. 9C is a plan view of a nichrome wire heat generating body (referred to as "outer surface heater B" hereinafter), and FIG. 9D is an elevational sectional view of the outer surface heater B.

The outer surface heater B comprises a substrate 911 and a nichrome electric heat generating body 912 provided on the substrate 911. The substrate 911 comprises an elongated flat plate made of ceramics and having a length of 360 mm, a width of 8 mm and a height of 1 to 2 mm. The nichrome electric heat generating body 912 is partially embedded into the substrate 911 and has a central heat generating portion 916 provided at both its ends with terminal portions 914. If necessary, a surface of the heat generating portion 916 may be coated by a glass protection layer.

Next, a temperature increasing speed and output feature of the heat source important for the present invention will be explained concretely with reference to FIG. 10.

Figure 10:
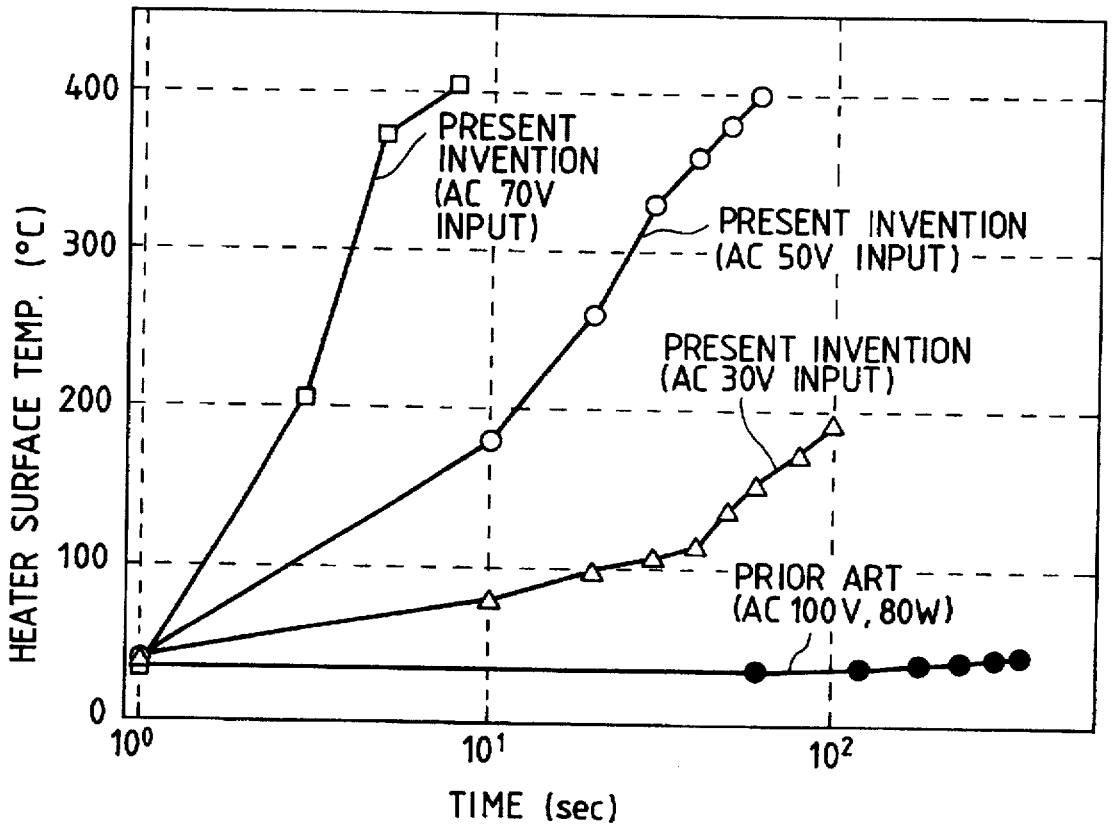
FIG. 10 is a graph showing a relation between temperature increase and output characteristic of the heat source.

In FIG. 10, the prior art relates to a surface-like heat generating body (referred to as "inner surface heater" hereinafter) formed by pinching a heat generating element such as a nichrome wire by polyethylene terephtalate resin layers. In the prior art example, the temperature increasing ratio per unit time is very small or slow. To the contrary, in the ceramic heater (outer surface heater A) according to the present invention, the temperature is increased up to 100° C. within several seconds (above 1 deg/sec and below 100 deg/sec), and the temperature increasing ratio can be controlled by input voltage.

Figure 4:
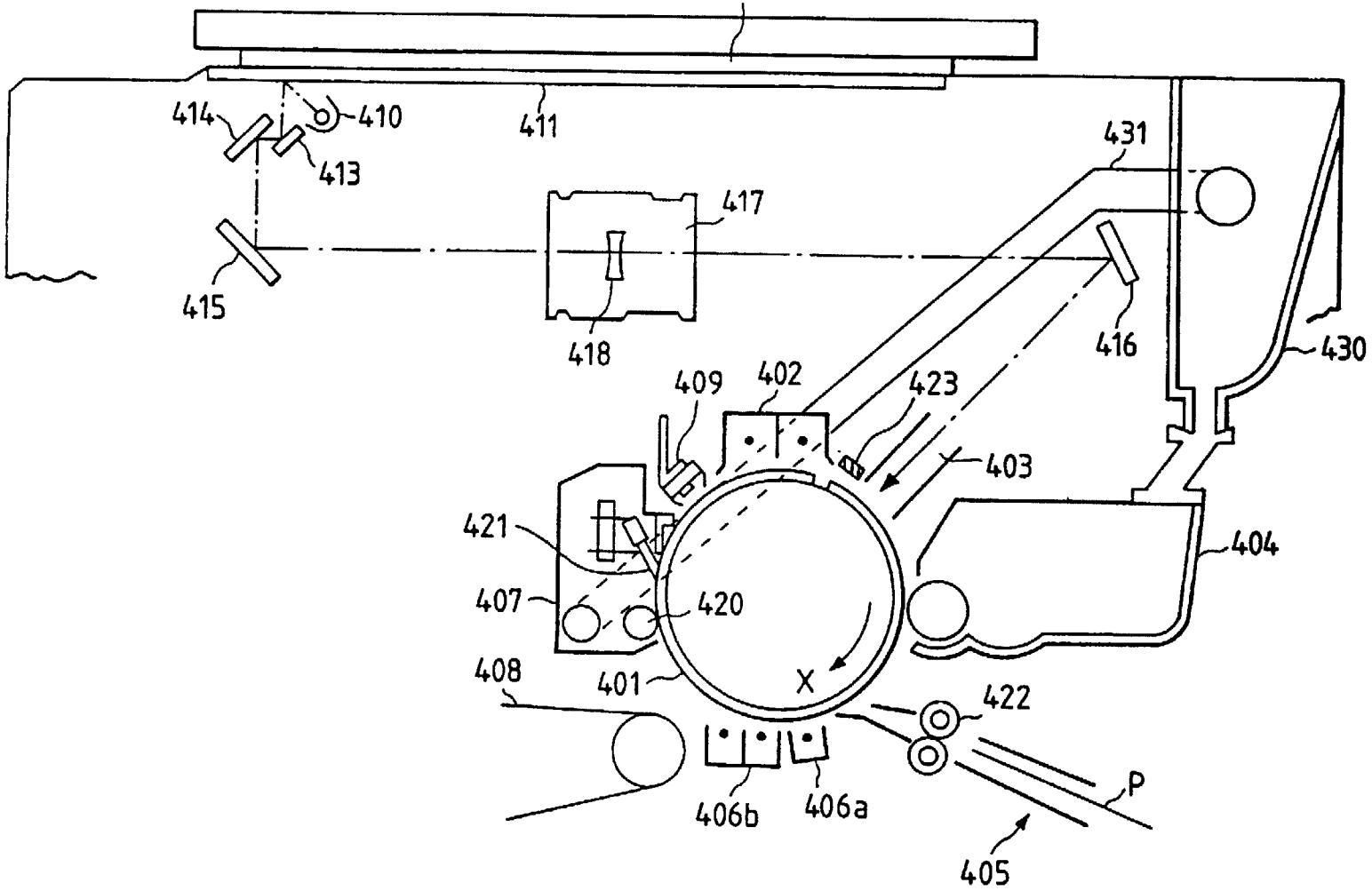
FIG. 4 is a schematic sectional view of an electrophotographing apparatus according to the present invention.

FIG. 4 is a schematic illustration showing an example of an image forming process of a copying machine including a toner re-using system having a heater according to the present invention. In FIG. 4, around a photosensitive member 401 rotated in a direction shown by the arrow X, there are disposed a heater 423 having a feature of the present invention, a main charger 402, an electrostatic latent image forming portion 403, a developing device 404, a transfer sheet supply system 405, a transfer charger 406*a*, a separation charger 406*b*, a cleaner 407, a convey system 408, an electricity removal light source 409 and the like. The heater 423 is constructed as mentioned above and is attached in a spaced relation to the surface of the photosensitive member 401 by a distance of 0.1 to 10 mm (preferably, 0.2 to 1 mm). It is most preferable that a portion of the heater 423 other than a surface portion opposed to the photosensitive member 401 is thermally insulated by glass fibers, ceramics or the like so as to permit heat radiation only toward the photosensitive member 401.

Now, the image forming process will be explained concretely.

The photosensitive member 401 is uniformly charged by the main charger 402 to which high voltage of +6 to 8 KV is applied. In the image forming portion 403, light emitted from a lamp 410 is reflected by an original 412 rested on an original support glass 411, and the reflected light is incident to the photosensitive member 401 through mirrors 413, 414, and 415, a focusing lens 418 of a lens unit 417 and a mirror 416, thereby forming an electrostatic latent image on the photosensitive member 401. Toner having negative polarity is supplied from the developing device 404 to the latent image, thereby visualizing the latent image as a toner image.

On the other hand, a tip end timing of a transfer material P supplied from the transfer sheet supply system 405 is adjusted by a pair of regist rollers 422. Then, the transfer material is introduced between the photosensitive member 401 and the transfer charger 406*a* to which high voltage of +7 to 8 KV is applied, where positive electric field having polarity opposite to that of the toner is applied to a back surface of the transfer material, thereby transferring the negative toner image formed on the surface of the photosensitive member 401 onto the transfer material P. Then, the transfer material is separated from the photosensitive member by means of the separation charger 406*b* to which high AC voltage having 12 to 14 KVp-p and 300 to 600 Hz is applied, and the separated transfer material P is sent, through the convey system 408, to a fixing device (not shown), where the toner image is fixed to the transfer material P. Thereafter, the transfer material P is discharged out of the copying machine.

The toner remaining on the photosensitive member 401 is partially absorbed by a magnet roller 420 of the cleaner 407 and the other residual toner is scraped off from the photosensitive member by a cleaning blade 421 of the cleaner 407. The scraped toner is collected into a hopper 430 through a convey screw 431 and is re-used. On the other hand, the photosensitive member 401 is polished by a magnetic brush of the magnet roller 420 and the electrostatic latent image remaining on the photosensitive member 401 is erased by the electricity removal light source 409. The magnet roller 420 includes a roller, and a magnet brush formed on the roller and contacted with the photosensitive member 401.

In the illustrated embodiment, since the collected waste toner is returned to the developing device 404 and is re-used, as the re-use of the toner is repeated, the toner is gradually apt to be fused and adhered to the photosensitive member 401. This is caused because, as the collection and re-use of the toner is repeated, the paper powder gradually penetrates into the toner and additive agent included in the toner to obtain the polishing effect is gradually decreased.

The additive agent serves to maintain the tribo of the toner itself within a predetermined range in order to eliminate defects such as endurance density change, fog or the like and has a polishing effect to moderately polish the surface of the photosensitive member.

Figure 16:
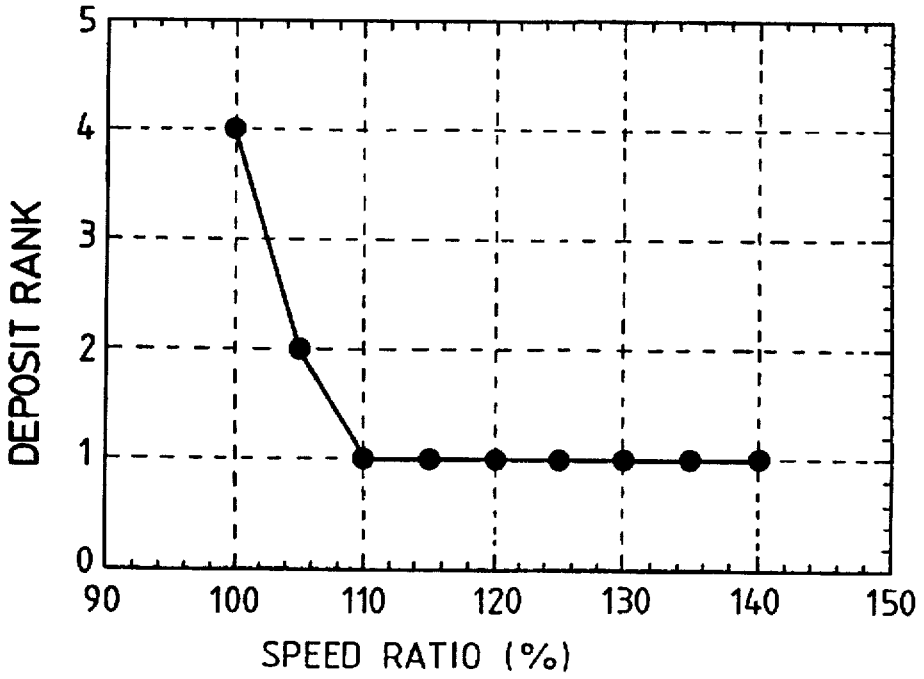
FIG. 16 is a graph showing a relation between a speed ratio (between a relative speed of a roller and a photosensitive member and a speed of the photosensitive member) and toner deposit in an electrophotographing apparatus according to the present invention.
Figure 17:
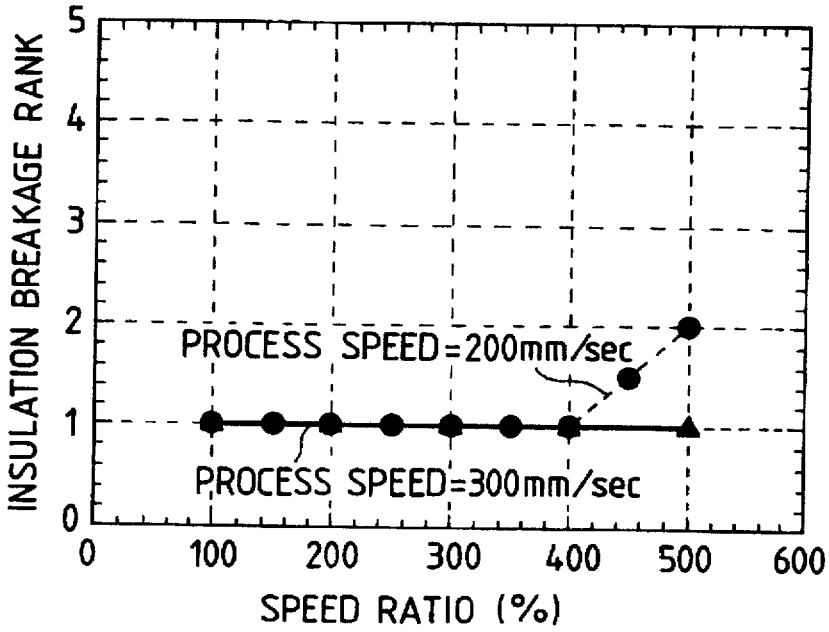
FIG. 17 is a graph showing a relation between a speed ratio (between a relative speed of a roller and a photosensitive member and a speed of the photosensitive member) and insulation breakage in the electrophotographing apparatus according to the present invention.

However, as the toner including the additive agent is subjected to the developing, transferring and cleaning processes repeatedly, since a ratio between the toner particles and the additive agent is changed reducing the inherent effect of the additive agent, the sufficient developing feature cannot be maintained. To avoid this, the components of the toner particle itself may be appropriately selected to eliminate the above-mentioned defects without adding the additive agent and to permit the re-use of the toner. In this case, since the toner does not include the additive agent, the polishing effect of the additive agent cannot be anticipated and the danger of adhering the toner on the photosensitive member is further increased. To avoid this, in the illustrated embodiment, the magnet roller 420 is provided in the cleaner 407 in such a manner that the magnet roller 420 is shifted in a direction opposite to a shifting direction of the surface of the photosensitive member 401 at a position where the magnet roller is opposed to the photosensitive member 401. FIGS. 16 and 17 show results obtained by changing a ratio of the relative speed of the magnet roller 420 to the shifting speed of the surface of the photosensitive member 401 (referred to as "speed ratio" hereinafter; in this case, when the speed ratio is 100%, it means that the magnet roller 420 is held stationary, and, when the speed ratio is smaller than 100%, it means that the magnet roller is shifted in the same direction as the shifting direction of the photosensitive member at the position where the magnet roller is opposed to the photosensitive member).

FIG. 16 is a graph showing deposit (fusion) generating conditions (plots) when the speed ratio is changed. The greater the value of the deposit rank the greater the deposit amount. As apparent from the result shown in FIG. 16, when the speed ratio is greater than 110%, the deposit preventing effect for preventing the toner from fusing on the photosensitive member is increased.

FIG. 17 is a graph showing image defect (insulation breakage of the photosensitive member 401) generating conditions (plots) when the speed ratio is changed. The greater the value of the insulation breakage rank the greater insulation breakage amount. As apparent from the result shown in FIG. 17, when the speed ratio exceeds 400%, the image defect starts to occur, and, when the shifting speed of the surface of the photosensitive member exceeds 300 mm/sec, the occurrence of the image defect can be suppressed.

Figure 13:
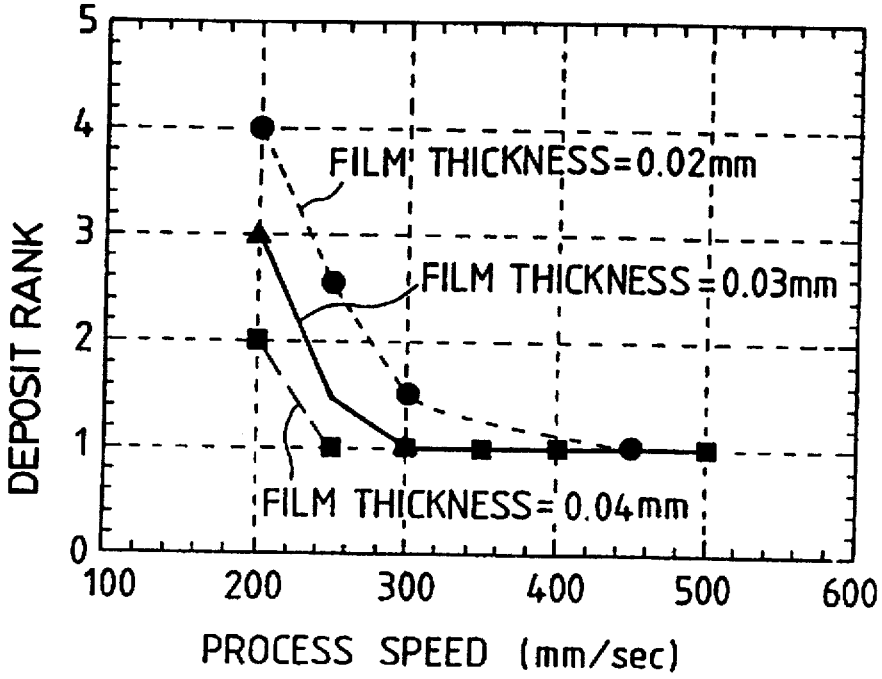
FIG. 13 is a graph showing a relation between a process speed and toner deposit in an electrophotographing apparatus according to the present invention.

FIG. 13 is a graph showing deposit (fusion) generating conditions (plots) when the shifting speed of the surface of the photosensitive member is changed. The greater the value of the deposit rank the greater the deposit amount. As apparent from the result shown in FIG. 13, when the shifting speed of the surface of the photosensitive member is greater then 300 mm/sec, the deposit preventing effect becomes more preferable.

Further, from FIG. 13, it can be seen that, when a film thickness (denoted by 1102 in FIGS. 11A to 11D and 1202 in FIG. 12) of the photosensitive member is d (mm) and the shifting speed of the surface of the photosensitive member 401 is v (mm/sec), it is preferable to satisfy a relation $d \times v \geqq 9$ in order to prevent the deposit of toner.

Figure 14:
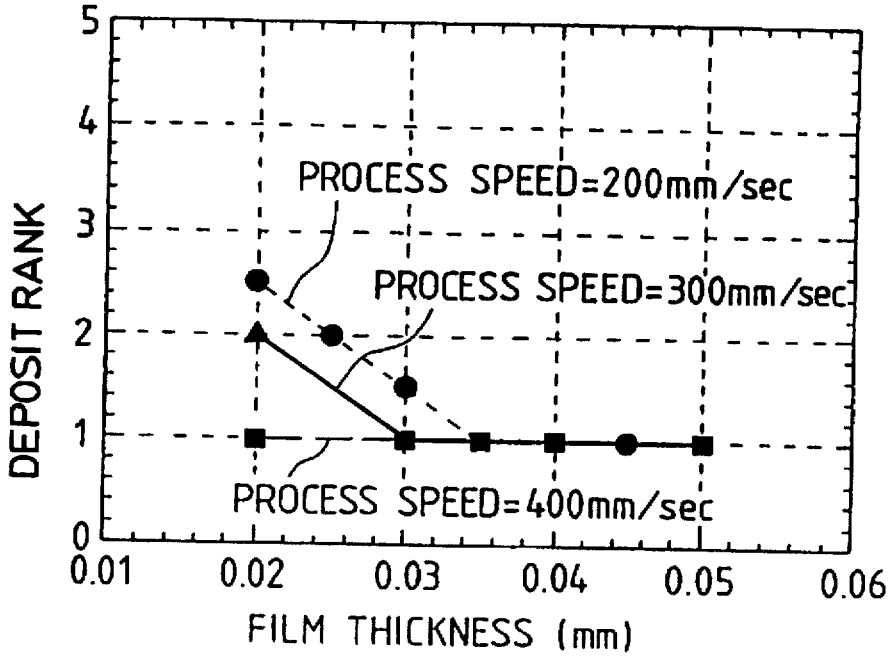
FIG. 14 is a graph showing a relation between a film thickness and toner deposit of the photo-conductive layer of the electrophotographic photosensitive member according to the present invention.

FIG. 14 is a graph showing deposit (fusion) generating conditions (plots) when the film thickness of the photosensitive member is changed. The greater the value of the deposit rank the greater the deposit amount. As apparent from the result shown in FIG. 14, in order to prevent the deposit of toner, it is preferable that the film thickness is greater than 0.03 mm.

Figure 15:
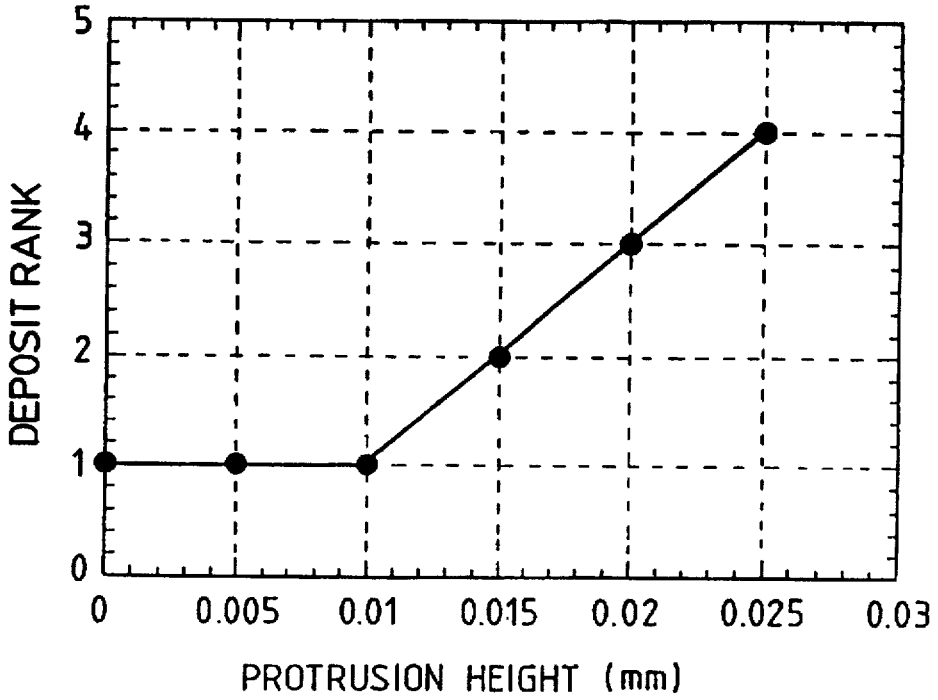
FIG. 15 is a graph showing a relation between a protrusion height and toner deposit of the photo-conductive layer of the electrophotographic photosensitive member according to the present invention.

FIG. 15 is a graph showing deposit (fusion) generating conditions (plots) when a height of a protrusion formed on the surface of the photosensitive member is changed. The greater the value of the deposit rank the greater the deposit amount. Here, the protrusion height means a maximum height the protrusion from the surface of the photosensitive member except for the protrusion. As apparent from the result shown in FIG. 15, in order to prevent the deposit of toner, it is preferable that the protrusion height is smaller than 0.01 mm.

Figure 18:
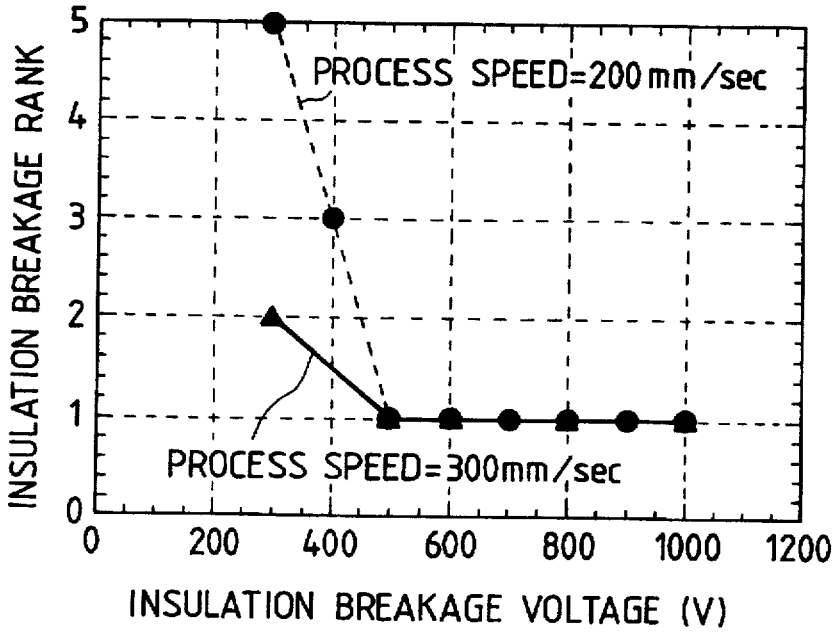
FIG. 18 is a graph showing a relation between an insulation breakage voltage (charging polarity and opposite polarity) and image fault due to insulation breakage of the photo-conductive layer of the electrophotographic photosensitive member according to the present invention.

FIG. 18 is a graph showing image defect (insulation breakage of the photosensitive member) generating conditions (plots) when the insulation breakage voltage to the voltage having the polarity opposite to that of the charging polarity of the photosensitive member is changed. The greater the value of the insulation breakage rank the greater insulation breakage amount. As apparent from the result shown in FIG. 18, when an absolute value of the insulation breakage voltage of the photosensitive member to the voltage having opposite polarity is smaller than 500 V, the image defect starts to occur, and, when the shifting speed of the surface of the photosensitive member exceeds 300 mm/sec, the occurrence of the image defect can be suppressed.

Further, in order to reduce probability of occurrence of the toner deposit, it is necessary to decrease the temperature of the photosensitive member as much as possible.

In the illustrated embodiment, by quickly heating the surface of the photosensitive member 401 by means of the heater 423 shown in FIG. 4, it is possible to (1) reduce the probability of occurrence of the toner deposit since the temperature of the photosensitive member itself is not increased, (2) remove the moisture efficiently due to the great difference in relative humidity between the quickly heated surface of the photosensitive member and the environmental atmosphere which is not yet heated, thereby preventing the image flow, (3) prevent the image unevenness caused by the thermal eccentricity of the developing device since the temperature increase of the interior of the electrophotographing apparatus is smaller than that of the surface of the photosensitive member while the moisture is being removed from the photosensitive member, (4) save the energy since the surface of the photosensitive member alone is mainly heated, and (5) omit the electricity supplying mechanism such as a slip ring conventionally required for installing the heat source within the cylindrical photosensitive member, thereby making the electrophotographing apparatus cheaper.

The inventors found that the good image stabilization can be achieved by quickly removing the moisture under a limited condition by using a photosensitive member having a small temperature depending feature and good surface heat resistance as another factor for achieving the above effects. Now, this will be explained hereinbelow.

[OPC photosensitive member]

An OPC photosensitive member which is one aspect of preferable photosensitive members used in the present invention will now be explained.

Figure 12:
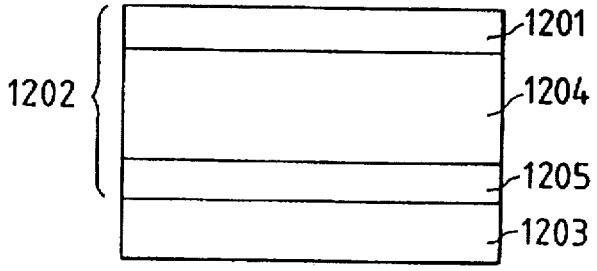
FIG. 12 is a view for explaining layers of an OPC photosensitive member according to the present invention.

FIG. 12 is schematic illustration for explaining layers of an electrophotographic photosensitive member according to the present invention. The electrophotographic OPC photosensitive member shown in FIG. 12 includes a photosensitive layer 1202 provided on a support 1203. The photosensitive layer 1202 comprises a charge generating layer 1205, a charge transfer layer 1204, and a surface forming and protecting layer 1201. If necessary, an intermediate layer may be disposed between the support 1203 and the charge generating layer 1205.

The OPC photosensitive member (i.e. surface layer, photo-conductive layer and optional intermediate layer) and particularly the surface layer must endure against high temperature radiation heat from the heater and be prevented from softening. It was found that the mixture of polyester resin having high melting point and curing resin affords both inherent effects of these resins and satisfies the requirements.

Now, components of resin used for forming the surface layer, photo-conductive layer, charge transfer layer and charge generating layer of the electrophotographic photosensitive member according to the present invention will be described.

Polyester is bond polymer including acid component and alcohol component and is obtained by condensation between dicarboxylic acid and glycol or condensation of compound including hydroxy group and carboxy group of hydroxy benzoic acid. The acid component may be an aromatic dicarboxylic acid such as terephthalic acid, isophthalic acid, naphthalene dicarboxylic acid and the like, or an aliphatic dicarboxylic acid such as succinic acid, adipic acid, sebacic acid and the like, or an alicyclic dicarboxylic acid such as hexahydro-terephthalic acid, or an oxycarboxylic acid such as hydroxy-ethoxy benzoic acid.

The glycol component may be ethylene glycol, trimethylene glycol, tetramethylene glycol, hexamethylene glycol, cyclohexane dimethylol, polyethylene glycol or polypropylene glycol.

Incidentally, within a range where the polyester resin substantially shows a linear relation, multifunctional compound such as pentaerythritol, trimethylol propane, pyromelit acid and their ester forming derivatives may be copolymerized.

In the present invention, high melting point polyester resin is used as the polyester resin. The high melting point polyester resin has limiting viscosity (measured in orthochlorophenol having a temperature of 36° C.) of 0.4 dl/g or more, and, preferably, 0.5 dl/g or more, and, more preferably, 0.65 dl/g or more. The preferable high melting point polyester resin may be resin of polyalkylene terephthalate group. The polyalkylene terephthalate resin mainly includes terephthalic acid as acid component, and alkylene glycol as glycol component.

More specifically, the terephthalate resin may be polyethylene terephthalate (PET) mainly including terephthalic acid component and ethylene glycol component, or polybutyline terephthalate (PBT) mainly including terephthalic acid component and 1,4-tetramethylene glycol (1,4-butylene glycol) component, or polycyclohexyl-dimethylene terephthalate (PCT) mainly including terephthalic acid component and cyclohexane-dimethylol component. Other preferable high molecular weight polyester resin may be resin of polyalkylene naphthalate group. The polyalkylene naphthalate resin mainly includes naphthalene dicarboxylic acid as acid component and alkylene glycol toner as glycol component, and typically may be polyethylene naphthalate (PEN) mainly including naphthalene dicarboxylic acid component and ethylene glycol component.

The high melting point polyester resin preferably has a melting point of 160° C. or more, and, more preferably 200° C. or more. The high melting point polyester resin has high crystallization because of its high melting point. As a result, the curing resin polymer chain and the high melting point polymer chain are uniformly and closely entangled to provide a surface layer having high durability. In case of low melting point polyester resins, because of low crystallization, the entanglement between the low melting point polymer chain and the curing resin polymer chain becomes uneven or irregular, thereby worsening the durability.

[Amorphous silicon photosensitive member]

An amorphous silicon photosensitive member which is another aspect of preferable photosensitive members used in the present invention will now be explained.

As a result of careful investigation regarding a relation between local condition distribution in a band gap and temperature dependency and/or optical memory of the charging ability, by paying attention to the movement of carrier in the photo-conductive layer of the amorphous silicon photosensitive member, it was found that the above object can be achieved by controlling local condition density of a predetermined energy range to be maintained within a certain range at least a portion of the photo-conductive layer to which the light is incident. That is to say, among photosensitive members having a photo-conductive layer made of non-monocrystal material including silicon atoms (as main component) and hydrogen atoms and/or halogen atoms, it was found that a photosensitive member designed and manufactured to identify its layer structure not only provides excellent practical features but also is superior to any conventional photosensitive member in every respect and has an excellent feature as an electrophotographic photosensitive member.

The electrophotographic photosensitive member according to the present invention comprises a conductive support, and a photosensitive layer having a photo-conductive layer made of non-monocrystal material including silicon atoms (as main component). The photo-conductive layer includes hydrogen of 10 to 30 atomic % and is characterized in that feature energy of exponential function tail (arback tall) of light absorption spectrum is 50 to 60 meV and local condition density (at 0.45 to 0.95 eV below transfer band end) is $3\times10^{14}$ to $3\times10^{15}$ $cm^{-3}$.

Further, the electrophotographic photosensitive member according to the present invention comprises a conductive support, and a light receiving layer having a photo-conductive layer made of non-monocrystal material including silicon atoms (as main components). In this case, the photo-conductive layer includes hydrogen and/or halogen of 10 to 30 atomic % and is characterized in that absorption peak strength ratio between Si—$H_2$ bond and Si—H bond obtained from infrared ray spectrum is 0.1 to 0.5, feature energy of exponential function tail (arback tail) of sub band gap light absorption spectrum is 50 to 60 meV and local condition density (at 0.45 to 0.95 eV below transfer band end) is $3\times10^{14}$ to $5\times10^{15}$ $cm^{-3}$.

The electrophotographic photosensitive member according to the present invention having the above-mentioned construction can eliminate all of the above-mentioned drawbacks and provide good electrical, optical and photoelectrical features, good image quality, good durability and good environmental feature.

Generally, in the band gap of a—Si:H, there are tail levels due to the structural distortion of Si—Si bond and a deep level due to structural defect such as non-bond hand. It is known that these levels serve to catch electrons and positive holes and act as a re-bond center, thereby worsening the property of the element.

As a method for measuring a condition of such localized level in the band gap, generally, deep level spectroscopy, isothermal over-capacity spectroscopy, photo-thermal deflection spectroscopy, constant photo-current method or the like is used. Among them, the constant photo-current method (referred to as "CPM" hereinafter) is useful as a method for easily measuring the sub gap light absorption spectrum based on the localized level of a—Si:H.

As a result of investigation regarding the relation between the local condition density (referred to as "DOS" hereinafter) and/or feature energy (referred to as "Eu" hereinafter) of the exponential function tail (arback tail) sought from the light absorption spectrum measured by CPM and the feature of the photosensitive member under various conditions, the inventors found that Eu and DOS have close relation to the temperature feature and light memory of the a—Si photosensitive member. And, on the basis of this, the present invention was completed.

The reason why the charging ability is decreased when the photosensitive member is heated by the drum heater and the like is that the thermally excited carrier is attracted by the electric field during the charging runs on the surface while repeating flow-in and flow-out with respect to the localized level of the band tail and/or the localized deep level of the band gap, thereby cancelling or offsetting the surface charge. In this case, although the charging ability is scarcely decreased regarding the carrier reached to the surface while passing through the charger, since the carrier captured in the deep level cancels the surface charge when it reaches the surface after it was passed through the charger, such carrier is observed as a temperature characteristic. Further, the thermally excited carrier after passing through the charger also cancels the surface charge, thereby decreasing the charging ability. Accordingly, in order to improve the temperature characteristic, it is necessary to suppress the formation of the thermally excited carrier in the usage temperature area of the photosensitive member and to improve the movement of the carrier.

Further, the light memory is generated when the light carrier formed by blank exposure and/or image exposure is captured in the localized level in the band gap to hold the carrier in the photo-conductive layer. That is to say, the residual carrier remaining in the photo-conductive layer (among the light carrier generated during a certain copying process) is discharged from the layer by the electric field generated by the surface charge during the next charging process and other processes so that the potential of a portion on which the light is illuminated becomes smaller than the potential of other portions, with the result that dark and bright portions are generated on the image. Accordingly, the movement of the carrier must be improved so that the light carrier can pass through during each copying cycle without remaining in the photo-conductive layer.

Therefore, by controlling Eu and DOS having a given energy range as is in the present invention, since it is possible to suppress the formation of the thermally excited carrier and to reduce the danger of capturing the thermally excited carrier and/or the light carrier in the localized level, the movement of the carrier is greatly improved. As a result, the temperature characteristic in the usage temperature area of the photosensitive member is remarkably improved, and, at the same time, since the generation of the light carrier can be suppressed, the stability of the photosensitive member under the usage environment is improved to clarify the half tone, thereby stably obtaining the image having high resolving power and high quality.

Next, the amorphous silicon photo-conductive member according to the present invention will be fully explained with reference to the accompanying drawings.

FIGS. 11A to 11D are schematic views for explaining the layers of the electrophotographic photosensitive member according to the present invention.

Figure 11A:
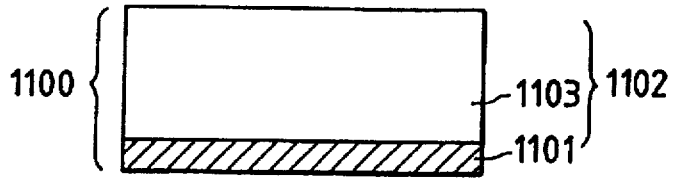
FIGS. 11A to 11D are views for explaining layers of an amorphous silicon photosensitive member according to the present invention.

The electrophotographic photosensitive member 1100 shown in FIG. 11A comprises a support 1101 and a photosensitive layer 1102 formed on the support. The photosensitive layer 1102 is constituted by a—Si:H,X and has a photo-conductive layer 1103 having photo-conductivity.

Figure 11B:
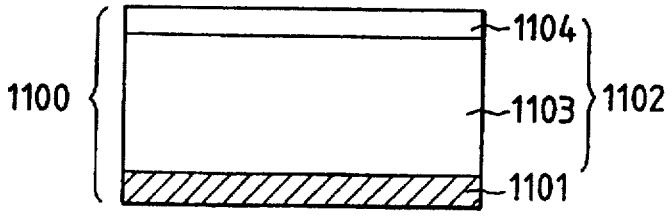

FIG. 11B is a schematic illustration for explaining another layer arrangement of the electrophotographic photosensitive member according to the present invention. In FIG. 11B, the electrophotographic photosensitive member 1100 comprises a support 1101 and a photosensitive layer 1102 formed on the support. The photosensitive layer 1102 is constituted by a—Si:H,X and has a photo-conductive layer 1103 having photo-conductivity and an amorphous silicon surface layer 1104.

Figure 11C:
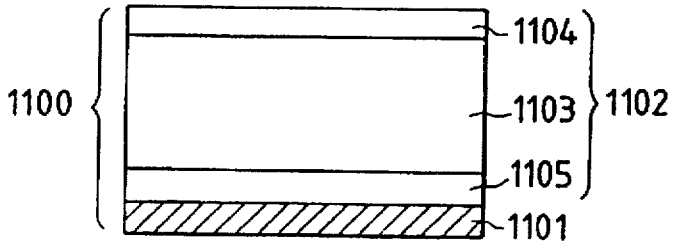

FIG. 11C is a schematic illustration for explaining a further layer arrangement of the electrophotographic photosensitive member according to the present invention. In FIG. 11C, the electrophotographic photosensitive member 1100 comprises a support 1101 and a photosensitive layer 1102 formed on the support. The photosensitive layer 1102 is constituted by a—Si:H,X, and has a photo-conductive layer 1103 having photo-conductivity, an amorphous silicon surface layer 1104 and an amorphous silicon charge injection element layer 1105.

Figure 11D:
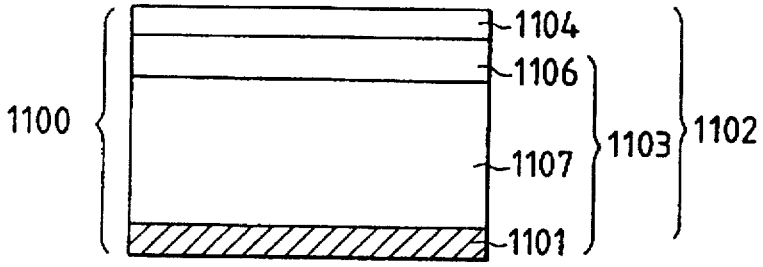

FIG. 11D is a schematic illustration for explaining a still further layer arrangement of the electrophotographic photosensitive member according to the present invention. In FIG. 11D, the electrophotographic photosensitive member 1100 comprises a support 1101 and a photosensitive layer 1102 formed on the support. The photosensitive layer 1102 has a charge generating layer 1106 constituted by a—Si:H,X and constituting a photo-conductive layer 1103, a charge transfer layer 1107 and an amorphous silicon surface layer 1104.

[Support]

The support 1101 used in the present invention may be conductive or electrically-insulative. The conductive support 1101 may be formed from metal such as Al (aluminium), Cr (chronium), Mo (molybdenum), Au (gold), In (indium), Nb (niobium), Te (tellurium), V (vanadium), Ti (titanium), Pt (platinum), Pd (palladium), Fe (iron) and their alloys (for example, stainless steel). Alternatively, the support may be formed from a synthetic resin film or sheet made of polyester, polyethylene, polycarbonate, cellulose acetate, polypropylene, polyvinyl chloride, polystyrene, polyamide or the like, or may be formed from an insulation plate made of glass, ceramics or the like. In this case, however, a surface of the film, sheet or insulation plate on which the photo-conductive layer 1102 is formed is made conductive by the surface treatment.

The support 1101 used in the present invention may be configured so as to form a cylindrical belt or plate-shaped endless belt having a smooth surface or an irregular surface, and a thickness of the belt can be appropriately selected to obtain a desired electrophotographic photosensitive member 1100. If the flexibility of the electrophotographic photosensitive member 1100 is required, the thickness of the belt is decreased as much as possible, so long as the function of the support 1101 is maintained. However, the thickness of the support 1101 is normally selected to be greater than 10 μm in consideration of mechanical strength during manufacturing and handling.

In particular, when the image formation is performed by utilizing coherent light such as laser light, in order to effectively avoid the poor image due to so-called interference fringes generated on the visualized image, the surface of the support 1101 may be irregular. The irregularity on the surface of the support 1101 may be formed by any conventional methods disclosed in the Japanese Patent Application Laid-open Nos. 60-168156 (1985), 60-178457 (1985) and 60-225854 (1985).

As another method for effectively avoiding the poor image due to the interference fringes generated when the coherent light such as laser light is used, the irregularity on the surface of the support 1101 may be formed by semi-spherical recesses. That is to say, the surface of the support 1101 has indentations smaller than a resolving power required for the electrophotographic photosensitive member 1100, and the indentations are constituted by a plurality of semi-spherical recesses. The irregularity on the surface of the support constituted by a plurality of semi-spherical recesses is formed by a conventional method disclosed in the Japanese Patent Application Laid-open No. 61-231561 (1986).

[Photo-conductive layer]

In the present invention, the photo-conductive layer 1103 forming a part of the photosensitive layer 1102 and formed on the support 1101 to effectively achieve the objects of the present invention is formed by a vacuum deposit film forming method so that values of film forming parameters are appropriately set to provide desired features. More specifically, the photo-conductive layer may be formed by various thin film deposit methods such as a glow discharge method (for example, alternate current or direct current discharge CVD methods such as a low frequency CVD method, high frequency CVD method or micro wave CVD method), a spattering method, a vacuum deposit method, an ion plating method, an optical CVD method, a thermal CVD method and the like. Although one of these thin film deposit methods is appropriately selected on the basis of various factors such as a manufacturing condition, the cost of equipment, a manufacturing scale, features requested for the electrophotographic photosensitive member to be manufactured and the like. Since the conditions for manufacturing the electrophotographic photosensitive member having the desired features can relatively easily be controlled, the glow discharge method (particularly, the high frequency glow discharge method using power source frequency having RF or VHF band) is preferable.

In order to form the photo-conductive layer 1103 by the glow discharge method, basically, Si (silicon) supplying raw material gas capable of supplying silicon atoms (Si) and H (hydrogen) supplying raw material gas capable of supplying hydrogen atoms (H) may be introduced into a sleeve, and/or Si supplying raw material gas and X (halogen) supplying raw material gas capable of supplying halogen atoms (X) may be introduced into a reaction vessel with desired gas condition so that glow discharge is caused in the sleeve and/or the reaction vessel, thereby forming a layer constituted by a—Si:H,X on the support 1101 arranged at a predetermined position.

Further, in the present invention, the hydrogen atoms and/or halogen atoms are included in the photo-conductive layer 1103. This ensures that non-bond hands of the silicon atoms are compensated and the quality of the layer (particularly, photo-conductivity and charge holding ability of the layer) is improved. Accordingly, it is desirable that the content of hydrogen atoms or halogen atoms, or a total amount of hydrogen atoms and halogen atoms is 10 to 30 atomic % (preferably, 15 to 25 atomic %) of the sum of silicon atoms and hydrogen atoms and/or halogen atoms.

Materials for providing Si (silicon) supplying gas used in the present invention may be silicon hidride (silane class) which is maintained in a gaseous condition or can be gasified, such as $SiH_4$, $Si_2H_6$, $Si_3H_8$, $Si_4H_{10}$ or the like. Among them, $SiH_4$ and $Si_2H_6$ are preferable in the points that they can be easily handled during the layer formation and they have good Si supplying rate.

In order to introduce hydrogen atoms into the photo-conductive layer 1103 to be formed, to facilitate the control of the introduction rate of the hydrogen atoms and to obtain the film feature achieving the objects of the present invention, it is necessary to form the layer by adding silicon compound including hydrogen ($H_2$) and/or helium (He) or hydrogen atoms to such gas by a desired amount. Further, each gas may be constituted by a single component or by mixing plural gases at a predetermined ratio.

Materials for providing halogen atom supplying raw material gas used in the present invention may be a halogen/halogen compound including halogen gas, halogenide or halogen, or a halogen compound which is maintained in a gaseous condition or can be gasified, such as silane derivative substituted by halogen. Alternatively, silicon hidride compound (including halogen atoms) which has silicon atoms and halogen atoms as structural components and which is maintained in a gaseous condition or can be gasified may be used. More specifically, halogen compound preferably used in the present invention may be a halogen/halogen compound such as gaseous fluorine ($F_2$), $BrF_2$, ClF, $ClF_3$, $BrF_3$, $BeF_5$, $IF_3$ or $IF_7$. Silicon compound including halogen atoms, i.e. silane derivative substituted by halogen may be fluorosilicon such as $SiF_4$, $Si_2F_6$ or the like.

In order to control the amount of hydrogen atoms and/or halogen atoms included in the photo-conductive layer 1103, for example, the temperature of the support 1101, an amount of the raw material used to provide the hydrogen atoms and/or halogen atoms which is introduced into the reaction vessel, and discharge electric power may be controlled. In the present invention, it is preferable that atoms for controlling the conductivity are included in the photo-conductive layer 1103 at need. The atoms for controlling the conductivity may be uniformly included in the entire photo-conductive layer 1103 or may be distributed unevenly along a thickness direction.

The atoms for controlling the conductivity may be so-called impurity in the semi-conductor field. That is, atoms belonging to IIIb group in the periodic table and providing p-type conductive feature (referred to as "IIIb group atom" hereinafter) or atoms belonging to Vb group in the periodic law table and providing n-type conductive feature (referred to as "Vb group atom" hereinafter) may be used.

The IIIb group atoms may be boron (B), aluminium (Al), gallium (Ga), indium (In) or thallium (Tl), and, particularly, B, Al and Ga are preferable. The Vb group atoms may be phosphorus (P), arsenic (As), antimony (Sb) or bismuth (Bi), and, particularly, P and As are preferable.

The content (amount) of atoms included in the photo-conductive layer 1103 is preferably $1\times10^{-2}$ to $1\times10^{4}$ atomic ppm, more preferably $5\times10^{-2}$ to $5\times10^{3}$ atomic ppm, and most preferably $1\times10^{-1}$ to $1\times10^{3}$ atomic ppm.

In order to structurally introduce the atoms for controlling the conductivity (for example, IIIb group atoms or Vb group atoms), when the layer is formed, gaseous raw material for introducing IIIb group atoms or Vb group atoms may be introduced into the reaction vessel together with other gas for forming the photo-conductive layer 1103. The raw materials for introducing IIIb group atoms or Vb group atoms may be maintained in a gaseous condition at room temperature and pressure or may easily be gasified at least under the layer forming condition.

More specifically, regarding the raw materials for introducing IIIb group atoms, arsenic atom introducing material may be arsenic hydride such as $B_2H_6$, $B_4H_{10}$, $B_5H_9$, $B_5H_{11}$, $B_6H_{10}$, $B_6H_{12}$, $B_6H_{14}$ or the like, or arsenic halogenide such as $BF_3$, $BCl_3$, $BBr_3$ or the like. Alternatively, $AlCl_3$, $GaCl_3$, $Ga(CH_3)_3$, $INCl_3$, or $TlCl_3$ may be used.

Regarding the raw materials for introducing Vb group atoms, phosphorus atom introducing material may be a phosphorus hydride such as $PH_3$, $P_2H_4$ or the like, or phosphorus halogenide such as $PH_4I$, $PF_3$, $PF_5$, $PCl_3$, $PCl_5$, $PBr_3$, $PBr_5$, $PI_3$ or the like. Alternatively, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ or $BiBr_3$ may be effectively used as the raw materials for introducing Vb group atoms.

Further, the atom introducing raw materials for controlling the conductivity may be diluted by hydrogen ($H_2$) and/or helium (He), if necessary.

Further, in the present invention, it is effective that carbon atoms and/or oxygen atoms and/or nitrogen atoms are included in the photo-conductive layer 1103. The content of the carbon atoms and/or oxygen atoms and/or nitrogen atoms is preferably $1\times10^{-5}$ to 10 atomic %, more preferably $1\times10^{-4}$ to 8 atomic %, and most preferably $1\times10^{-3}$ to 5 atomic % with respect to the sum of silicon atoms, carbon atoms, oxygen atoms and nitrogen atoms. The carbon atoms and/or oxygen atoms and/or nitrogen atoms may be uniformly included in the entire photo-conductive layer 1103 or may be distributed unevenly along a thickness direction so that the content is changed in the thickness direction.

In the present invention, the thickness of the photo-conductive layer 1103 is determined to provide the desired electrophotographic feature and the desired economical effect, and has a value of preferably 20 to 50 μm, more preferably 23 to 45 μm, and most preferably 25 to 40 μm.

In order to form the photo-conductive layer 1103 achieving the objects of the present invention and having the desired film feature, it is necessary to appropriately adjust the mixing ratio between the Si supplying gas and the dilute gas, gas pressure in the reaction vessel, discharge electric power and temperature of the support. Although a flow rate of hydrogen ($H_2$) and/or helium (He) used as the dilute gas is appropriately selected in accordance with the layer design, normally, it is desirable that the amount of hydrogen ($H_2$) and/or helium (He) is controlled to be greater than the amount of Si supplying gas by 3 to 20 times, preferably 4 to 15 times, and more preferably 5 to 10 times.

Although the gas pressure in the reaction vessel is similarly selected within the optimum range in accordance with the layer design, normally, it is desirable that the gas pressure has a value of $1\times10^{-4}$ to 10 Torr, preferably $5\times10^{-4}$ to 5 Torr, and more preferably $1\times10^{-3}$ to 1 Torr.

Although the discharge electric power is similarly selected within the optimum range in accordance with the layer design, normally, it is desirable that the discharge electric power is greater than the flow rate of the Si supplying gas by 2 to 7 times, preferably 2.5 to 6 times, and more preferably 3 to 5 times.

Further, although the temperature of the support 1101 is similarly selected within the optimum range in accordance with the layer design, normally, it is desirable that the temperature is preferably 200° to 350° C., preferably 230° to 330° C., and most preferably 250° to 350° C.

In the present invention, although the temperature of the support 1101 and the gas pressure for forming the photo-conductive layer 1103 have the above-mentioned desired values, it is desirable that these values are normally not determined independently, but are determined in consideration of a relation between these factors to obtain the photosensitive member 1100 having the desired feature.

[Surface layer]

In the present invention, it is preferable that amorphous silicon surface layer 1104 is formed on the photo-conductive layer 1103 provided on the support 1101 as mentioned above. The surface layer 1104 has a free surface 1106 and serves to achieve the objects of the present invention, mainly regarding the anti-moisture feature, continuous repeated using feature, anti-voltage feature, usage environmental feature and durability.

Further, in the present invention, since the noncrystalline materials for forming the photo-conductive layer 1103 and the surface layer 1104 (which layers constitute the photosensitive layer 1102) have a common factor (silicon atoms), chemical stability is fully ensured at interface between the layers.

Although the surface layer 1104 can be made of any amorphous silicon material, it is preferable that the surface layer is made of amorphous silicon (referred to as "a—SiC:H,X" hereinafter) including hydrogen atoms (H) and/or halogen atoms (X) and further including carbon atoms (C), or amorphous silicon (referred to as "a—SiO:H, X" hereinafter) including hydrogen atoms (H) and/or halogen atoms (X) and further including oxygen atoms (O), or amorphous silicon (referred to as "a—SiN:H,X" hereinafter) including hydrogen atoms (H) and/or halogen atoms (X) and further including nitrogen atoms (N), or amorphous silicon (referred to as "a—SiCON:H,X" hereinafter) including hydrogen atoms (H) and/or halogen atoms (X) and further including at least one of carbon atoms (C), oxygen atoms (O) and nitrogen atoms (N).

According to the present invention, in order to achieve the objects effectively, the surface layer 1104 is formed by vacuum deposit film forming method in such a manner that the values of film forming parameters are appropriately set to obtain the desired features. More specifically, the surface layer can be formed by various thin film deposit methods such as a glow discharge method (for example, alternate current or direct current discharge CVD method such as low the frequency CVD method, high frequency CVD method or micro wave CVD method), a spattering method, a vacuum deposit method, an ion plating method, an optical CVD method, a thermal CVD method and the like. Although one of these thin film deposit methods is appropriately selected on the basis of various factors such as a manufacturing condition, the cost of equipment, a manufacturing scale, features requested for the electrophotographic photosensitive member to be manufactured and the like, it is preferable that the deposit method same as the method for forming the photo-conductive layer is used in consideration of the productivity of the photosensitive member.

For example, in order to form the surface layer 1104 comprised of a—SiC:H,X the glow discharge method, basically, Si supplying raw material gas capable of supplying silicon atoms (Si), C supplying raw material gas capable of supplying carbon atoms (C) and H supplying raw material gas capable of supplying hydrogen atoms (H) and/or X supplying raw material gas capable of supplying halogen atoms (X) may be introduced into a reaction vessel (internal pressure of which can be reduced) with desired gas condition so that glow discharge is caused in the reaction vessel, thereby forming a layer constituted by a—SiC:H,X on the support 1101 (on which the photo-conductive layer 1103 was formed) arranged at a predetermined position.

Although the surface layer 1104 used in the present invention may be made of any amorphous silicon material including silicon, the surface layer is preferably made of a compound of silicon atoms including at least one of the elements such as carbon, nitrogen and oxygen, and is more preferably made of material including a—SiC as main component. When the surface layer 1104 is made of material including a—SiC as main component, the amount of carbon is preferably 30 to 90% of the sum of silicon atoms and carbon atoms.

Further, in the present invention, it is required that the hydrogen atoms and/or halogen atoms are included in the surface layer 1104 in order to compensate non-bond hands of the silicon atoms and to improve the quality of the layer (particularly, the photo-conductive feature and charge holding feature). The content of hydrogen with respect to the total amount of all of atoms is normally 30 to 70 atomic %, preferably 35 to 65 atomic %, and more preferably 40 to 60 atomic %. Further, it is desirable that the content of fluorine atoms is normally 0.01 to 15 atomic %, preferably 0.1 to 10 atomic %, and more preferably 0.6 to 4 atomic %.

The photosensitive member formed with hydrogen atoms and/or fluorine atoms having the contents as indicated above is superior to the conventional photosensitive members with respect to practical use and can be fully utilized. That is to say, it is known that the defects mainly, dangling bond of silicon atoms and/or carbon atoms) affect a bad influence upon the feature of the electrophotographic photosensitive member. For example, such bad influence includes deterioration of the charging feature due to injection of charges from free surface, fluctuation of the charging feature due to the change in structure of layers under the usage environment (for example, high humidity condition), and occurrence of residual image due to the repeated use during which the charges are injected into the surface layer from the photo-conductive layer in the corona charging and light illumination and the charges are trapped in the defects (damaged portions) of the surface layer.

However, by controlling the content of the hydrogen above 30 atomic %, the defects of the surface layer are greatly decreased, with the result that it is possible to remarkably improve the electrical feature and high speed continuous utilization in comparison with the prior art.

On the other hand, if the hydrogen content in the surface layer exceeds 71 atomic %, since the hardness of the surface layer is increased, the photosensitive member cannot be used repeatedly. Accordingly, the fact that the hydrogen content in the surface layer is controlled within the above-mentioned range is one of the very important factors for providing an excellent electrophotographic feature. The hydrogen content in the surface layer can be controlled by a flow rate of hydrogen gas ($H_2$), temperature of the support, discharge power, gas pressure and the like.

Further, by controlling the fluorine content in the surface layer above 0.01 atomic %, it is possible to effectively achieve a bond between the silicon atoms and the carbon atoms in the surface layer. In addition, the fluorine atoms serve to effectively prevent the breakage of bond between the silicon atoms and the carbon atoms due to the damage caused by corona.

On the other hand, if the fluorine content in the surface layer exceeds 15 atomic %, the occurrence of bond between the silicon atoms and the carbon atoms in the surface layer and the prevention of the breakage of bond between the silicon atoms and the carbon atoms due to the damage caused by corona can scarcely be achieved. Further, since the excessive fluorine atoms affect a bad influence upon the movement of the carrier in the surface layer, residual potential and image memory noticeably appear. Accordingly, the fact that the fluorine content in the surface layer is controlled within the above-mentioned range is one of important factors for providing excellent electrohptographic feature. Similar to the hydrogen content, the fluorine content in the surface layer can be controlled by a flow rate of hydrogen gas ($H_2$), temperature of the support, discharge power, gas pressure and the like.

Materials for providing silicon (Si) supplying gas used in the formation of the surface layer 1104 of the present invention may be silicon hydride (silane class) which is maintained in a gaseous condition or can be gasified, such as $SiH_4$, $Si_2H_6$, $Si_3H_6$, $Si_3H_8$, $Si_4H_{10}$ or the like. Among them, $SiH_4$ and $Si_2H_6$ are preferable in the points that they can be easily handled during the layer formation and they have a good Si supplying rate. Further, a Si supplying raw material gas may be diluted by hydrogen gas ($H_2$), helium gas (He), argon gas (Ar) or neon gas (Ne), if necessary.

Materials for providing carbon supplying gas may be hydrocarbon which is maintained in a gaseous condition or can be gasified, such as $CH_4$, $C_2H_6$, $C_3H_8$, $C_4H_{10}$ or the like. Among them, $CH_4$ and $C_2H_6$ are preferable in the points that they can be easily handled during the layer formation and they have good Si supplying rate. Further, the carbon supplying raw material gas may be diluted by hydrogen gas ($H_2$), helium gas (He), argon gas (Ar) or neon gas (Ne), if necessary.

Materials for providing nitrogen or oxygen supplying gas may be a compound which is maintained in a gaseous condition or can be gasified, such as $NH_3$, NO, $N_2O$, $NO_2$, $H_2O$, $O_2$, CO, $CO_2$, $N_2$ or the like. Further, the carbon supplying raw material gas may be diluted by hydrogen gas ($H_2$), helium gas (He), argon gas (Ar) or neon gas (Ne), if necessary.

Further, in order to more facilitate the control of the introduction ratio of the hydrogen atoms to be introduced into the surface layer to be formed, it is preferable that silicon compound gas including hydrogen gas or hydrogen atoms is added to the above-mentioned gas at a desired rate to form the layer. In addition, each gas may be constituted by a single component or by mixing plural gases at a predetermined ratio.

Materials for providing a halogen atom supplying raw material gas used in the present invention may be a halogen/halogen compound including halogen gas, halogenide or halogen, or halogen compound which is maintained in a gaseous condition or can be gasified, such as a silane derivative substituted by halogen. Alternatively, a silicon hydride compound (including halogen atoms) which has silicon atoms and halogen atoms as structural components and which is maintained in a gaseous condition or can be gasified may be used.

More specifically, the halogen compound preferably used in the present invention may be a halogen/halogen compound such as fluorine gas ($F_2$), BrF, ClF, $ClF_3$, $BrF_3$, $BeF_5$, $IF_3$ or $IF_7$. The silicon compound including halogen atoms, i.e. silane derivative substituted by halogen may be fluorosilicon such as $SiF_4$, $Si_2F_6$ or the like.

In order to control the amount of hydrogen atoms and/or halogen atoms included in the surface layer 1104, for example, the temperature of the support 1101, an amount of the raw material used to provide the hydrogen atoms and/or halogen atoms which is introduced into the reaction vessel, and discharge electric power may be controlled. The carbon atoms and/or hydrogen atoms and/or nitrogen atoms may be uniformly included in the entire surface layer 1104 or may be distributed unevenly to change the content along a thickness direction.

Further, in the present invention, it is preferable that atoms for controlling the conductivity are included in the surface layer 1104. The atoms for controlling the conductivity may be uniformly included in the entire surface layer 1104 or may be distributed unevenly along a thickness direction.

The atoms for controlling the conductivity may be so-called impurity in the semi-conductor field. That is, atoms belonging to IIIb group in the periodic law table and providing p-type conductive feature (referred to as "IIIb group atom" hereinafter) or atoms belonging to Vb group in the periodic law table and providing n-type conductive feature (referred to as "Vb group atom" hereinafter) may be used.

The IIIb group atoms may be boron (B), aluminum (Al), gallium (Ga), indium (In) or thallium (Tl), and, particularly, B, Al and Ga are preferable. The Vb group atoms may be phosphorus (P), arsenic (As), antimony (Sb) or bismuth (Bi), and, particularly, P and As are preferable.

The content (amount) of atoms for controlling the conductivity included in the surface layer 1104 is preferably $1\times10^{-3}$ to $1\times10^{3}$ atomic ppm, more preferably $5\times10^{-2}$ to $5\times10^{2}$ atomic ppm, and most preferably $1\times10^{-1}$ to $1\times10^{2}$ atomic ppm.

In order to structurally introduce the atoms for controlling the conductivity (for example, IIIb group atoms or Vb group atoms), when the layer is formed, gaseous raw material for introducing IIIb group atoms or Vb group atoms may be introduced into the reaction vessel together with other gas for forming the surface layer 1104. The raw materials for introducing IIIb group atoms or Vb group atoms may be maintained in a gaseous condition at room temperature and pressure or may easily be gasified at least under the layer forming condition.

More specifically, regarding the raw materials for introducing IIIb group atoms, arsenic atom introducing material may be arsenic hydride such as $B_2H_6$, $B_4H_{10}$, $B_5H_9$, $B_5H_{11}$, $B_6H_{10}$, $B_6H_{12}$, $B_6H_{14}$ or the like, or arsenic halogenide such as $BF_3$, $BCl_3$, $BBr_3$ or the like. Alternatively, $AlCl_3$, $GaCl_3$, $Ga(CH_3)_3$, $InCl_3$, or $TlCl_3$ may be used.

Regarding the raw materials for introducing Vb group atoms, phosphorus atom introducing material may be phosphorus hydride such as $PH_3$, $P_2H_4$ or the like, or phosphorus halogenide such as $PH_4I$, $PF_3$, $PF_5$, $PCl_3$, $PCl_5$, $PBr_3$, $PBr_5$, $PI_3$ or the like. Alternatively, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ or $BiBr_3$ may be effectively used as the raw materials for introducing Vb group atoms.

Further, the atom introducing raw materials for controlling the conductivity may be diluted by hydrogen gas ($H_2$), helium (He), argon gas (Ar) or neon gas (Ne), if necessary.

It is desirable that a thickness of the surface layer 1104 according to the present invention is 0.01 to 3 μm, preferably 0.05 to 2 μm, and more preferably 0.1 to 1 μm. If the layer thickness is smaller than 0.01 μm, the surface layer 1104 is worn out due to wear during the operation of the photosensitive member 1100; whereas, if the layer thickness is greater than 3 μm, the electrophotographic feature is worsened due to an increase in residual potential and the like.

The surface layer 1104 according to the present invention is carefully formed to provide the desired feature. That is to say, the materials including silicon (Si), carbon (C) and/or oxygen (O), hydrogen (H) and/or halogen (X) as structural components structurally change from a crystalline condition to an amorphous condition depending upon the formation conditions, and, electrically shows any feature from conductor feature to insulator feature through semi-conductor feature, and further shows any feature from photoconductive feature to non-photo-conductive feature. Thus, in the present invention, the formation condition is strictly selected at need to obtain a compound having the desired feature achieving the objects. For example, when the surface layer 1104 is mainly used to improve durability, the surface layer is formed from non-crystalline material having electrical insulation feature under the usage environment.

Further, when the surface layer 1104 is mainly used to improve the continuous repeated usage feature and/or usage environment feature, the surface layer is formed from non-crystalline material having less electrical insulation feature and sensitivity feature sensitive to the illumination light more or less.

In order to form the surface layer 1104 having the feature capable of achieving the objects of the present invention, it is necessary to appropriately set the temperature of the support 1101 and the gas pressure in the reaction vessel upon demand.

The temperature (Ts) of the support 1101 is appropriately selected in accordance with the layer design, and is normally 200° to 350° C., preferably 230° to 330° C., and more preferably 250° to 300° C.

Although the gas pressure in the reaction vessel is similarly selected within the optimum range in accordance with the layer design, normally, it is desirable that the gas pressure has a value of $1\times10^{-4}$ to 10 Torr, preferably $5\times10^{-4}$ to 5 Torr, and more preferably $1\times10^{-3}$ to 1 Torr.

In the present invention, although the temperature (Ts) of the support 1101 and the gas pressure for forming the surface layer 1104 have the above-mentioned desired values, it is desirable that these values are normally not determined independently, but are determined in consideration of a relation between these factors to obtain the photosensitive member 1100 having the desired feature.

Further, in the present invention, a blocking layer (referred to as "lower surface layer" hereinafter) including carbon atoms, oxygen atoms and nitrogen atoms contents of which are smaller than those in the surface layer 1104 may be formed between the photo-conductive layer 1103 and the surface layer 1104 to further improve the charging ability. Further, between the surface layer 1104 and the photo-conductive layer 1103, there may be provided an area where the contents of carbon atoms and/or oxygen atoms and/or nitrogen atoms are changed to be decreased toward the photo-conductive layer 1103. By providing this area, it is possible to improve adhesion between the surface layer 1104 and the photo-conductive layer 1103 and to reduce the influence of interference of light reflected by the interface.

[Charge injection preventing layer]

In the electrophotographic photosensitive member 1100 according to the present invention, it is more effective to provide, between the conductive support 1101 and the photo-conductive layer 1103, a charge injection preventing layer 1105 capable of preventing the charges from injecting from the conductive support 1101. That is to say, the charge injection preventing layer 1105 has a function for preventing the charges from injecting from the conductive support 1101 to the photo-conductive layer 1103 when the free surface of the photosensitive layer 1102 is subjected to charge (having given polarity) treatment. However, when the free surface of the photosensitive layer 1102 is subjected to charge (having opposite polarity) treatment, such a function has not been effected. That is to say, the charge injection preventing layer has a polarity depending feature. To obtain such a function, an amount of the atoms for controlling the conductivity in the charge injection preventing layer 1105 is made relatively greater than that in the photo-conductive layer 1103. The atoms for controlling the conductivity included in the photo-conductive layer 1103 may be uniformly included in the entire photo-conductive layer 1103 or may be distributed unevenly along a thickness direction. When the distribution density is uneven, it is desirable that the atoms distributed near the support 1101 are greater than those near the photo-conductive layer 1103.

However, in any case, it is necessary that the atoms are uniformly distributed in a plane parallel with the surface of the support 1101 to make the feature uniform along the plane. The atoms for controlling the conductivity included in the charge injection preventing layer 1105 may be so-called impurity in the semi-conductor field. That is, atoms belonging to IIIb group in the periodic law table and providing p-type conductive feature (referred to as "IIIb group atom" hereinafter) or atoms belonging to Vb group in the periodic law table and providing n-type conductive feature (referred to as "Vb group atom" hereinafter) may be used.

The IIIb group atoms may be boron (B), aluminum (Al), gallium (Ga), indium (In) or thallium (Tl), and, particularly, B, Al and Ga are preferable. The Vb group atoms may be phosphorus (P), arsenic (As), antimony (Sb) or bismuth (Bi), and, particularly, P and As are preferable.

In the present invention, the content (amount) of atoms included in the charge injection preventing layer 1105 is appropriately determined upon demand to effectively achieve the objects of the present invention, and is preferably 10 to $1\times10^4$ atomic ppm, more preferably 50 to $5\times10^3$ atomic ppm, and most preferably $1\times10^2$ to $1\times10^3$ atomic ppm. Further, by adding at least one of carbon atoms, nitrogen atoms and oxygen atoms to the charge injection preventing layer 1105, it is possible to further improve the close contact between the charge injection preventing layer 1105 and the layer directly contacted with the charge injection preventing layer.

The carbon atoms, nitrogen atoms or oxygen atoms included in the charge injection preventing layer 1105 may be uniformly included in the entire charge injection preventing layer 1105 or may be distributed unevenly along the entire thickness direction. However, in any case, it is necessary that the atoms are uniformly distributed in a plane parallel with the surface of the support 1101 to make the feature uniform along the plane.

The content of the carbon atoms and/or nitrogen atoms and/or oxygen atoms included in the entire area of the charge injection preventing layer 1105 according to the present invention appropriately determined to effectively achieve the objects of the present invention, and is preferably $1\times10^{-3}$ to 50 atomic %, more preferably $5\times10^{-3}$ to 30 atomic %, and most preferably $1\times10^{-2}$ to 10 atomic % (as amount of one kind or as total amount of two or three kinds).

Further, the hydrogen atoms and/or halogen atoms included in the charge injection preventing layer 1105 according to the present invention compensate the non-bond hands remaining in the layer, thereby improving the film quality. It is desirable that the content of the hydrogen atoms or halogen atoms or the total content of the hydrogen atoms or halogen atoms included in the charge injection preventing layer 1105 is preferably 1 to 50 atomic %, more preferably 5 to 40 atomic %, and most preferably 10 to 30 atomic %.

In the present invention, a thickness of the charge injection preventing layer 1105 is preferably 0.1 to 5 μm, more preferably 0.3 to 4 μm, and most preferably 0.5 to 3 μm.

In the present invention, the same vacuum deposit method as used in the formation of the photo-conductive layer 1103 is utilized to form the charge injection preventing layer 1105.

In order to form the charge injection preventing layer 1105 having the features achieving the objects of the present invention, as is in the photo-conductive layer 1103, it is necessary to appropriately set the ratio of the mixture between Si supplying gas and dilute gas, the gas pressure in the reaction vessel, the discharge electric power and the temperature of the support 1101. Although the flow rate of the hydrogen gas ($H_2$) and/or helium gas (He) acting as the dilute gas is appropriately selected within the optimum range in accordance with the layer design, it is desirable that the amount of the hydrogen gas ($H_2$) and/or helium gas (He) is greater than the Si supplying gas by normally 1 to 2 times, preferably 3 to 10 times, and more preferably 5 to 15 times.

Similarly, although the gas pressure in the reaction vessel is selected within the optimum range in accordance with the layer design, normally, it is desirable that the gas pressure has a value of $1\times10^{-4}$ to 10 Torr, preferably $5\times10^{-4}$ to 5 Torr, and more preferably $1\times10^{-3}$ to 1 Torr.

Although the discharge electric power is similarly selected within the optimum range in accordance with the layer design, it is desirable that the discharge electric power is greater than the flow rate of Si supplying gas by normally 1 to 7 times, preferably 2 to 6 times, and more preferably 3 to 5 times. Further, although the temperature of the support 1101 is selected within the optimum range in accordance with the layer design, normally, it is desirable that the temperature is normally 200° to 350° C., preferably 230° to 330° C., and more preferably 250° to 300° C.

In the present invention, although the ratio of the mixture between the supplying gas and the dilute gas, the gas pressure in the reaction vessel, the discharge electric power and the temperature of the support 1101 for forming the charge injection preventing layer 1105 have the above-mentioned desired values. It is desirable that these values are normally not determined independently, but are determined in consideration of a relation between these factors to obtain the surface layer 1104 having the desired feature. Further, in the electrophotographic photosensitive member 1100 according to the present invention, on the photosensitive layer 1102 near the support 1101, there may be provided a layer area in which at least aluminum atoms, silicon atoms, hydrogen atoms and/or halogen atoms are unevenly distributed along a thickness direction thereof.

Further, in the electrophotographic photosensitive member 1100 according to the present invention, in order to further improve the adhesion between the support 1101 and the photo-conductive layer 1103 or the charge injection preventing layer 1105, there may be provided an adhesion layer made of noncrystalline material including, for example, $Si_3N_4$, $SiO_2$, SiO or silicon atoms as base components and further including hydrogen atoms and/or halogen atoms, and, carbon atoms and/or oxygen atoms and/or nitrogen atoms. Further, a light absorption layer for preventing the occurrence of interference fringes of light reflected from the support 1101 may be provided.

Next, an apparatus and a film forming method for forming the photosensitive layer 1102 will be explained.

Figure 2:
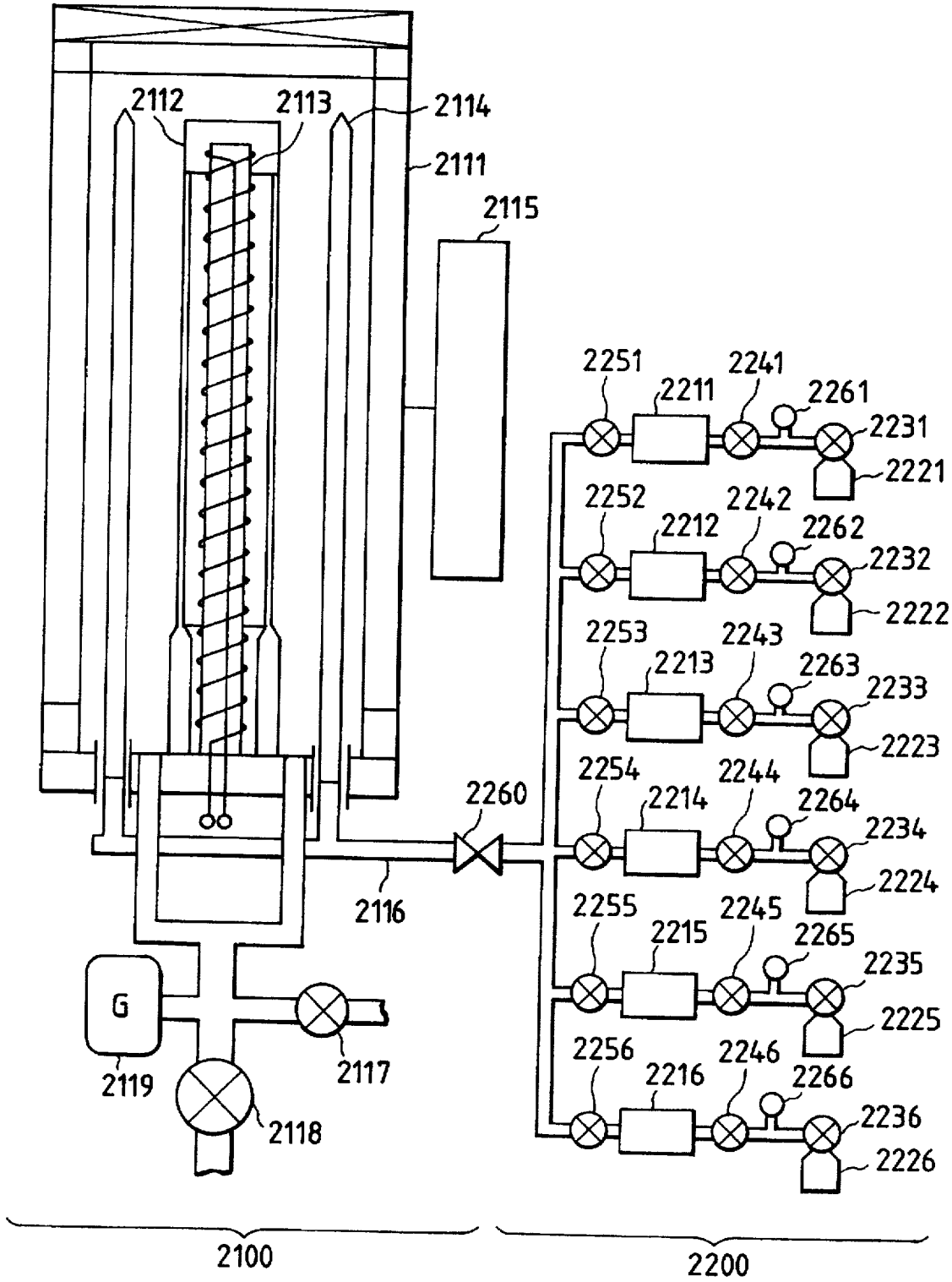
FIG. 2 is a schematic illustration for explaining a device for manufacturing an electrophotographic photosensitive member by means of a glow discharge method using high frequency wave having RF band.

FIG. 2 schematically shows an example of an apparatus for manufacturing the electrophotographic photosensitive member by utilizing a high frequency plasma CVD method using RF band as power source frequency (referred to as "RF-PCVD method" hereinafter).

This manufacturing apparatus generally comprises a deposit device 2100, a raw material gas supplying device 2200, and a discharge device (not shown) for reducing pressure in a reaction device 2111. A cylindrical support 2112, a heater 2113 for heating the support, and raw material gas introduction conduits 2114 are disposed within the reaction vessel 2111 of the deposit device 2100, and a high frequency matching box 2115 is connected to the vessel. The raw material gas supplying device 2200 is constituted by bombs 2221–2226 for containing raw material gases such as $SiH_4$, $GeH_4$, $H_2$, $CH_4$, $B_2H_6$ and $PH_3$, valves 2231–2236, 2241–2246, 2251–2256, and mass flow controllers 2211–2216, and the raw material gas bombs 2221–2226 are connected to the gas introduction conduit 2114 in the reaction vessel 2111 through a valve 2260.

The formation of the deposit film is performed by using the above-mentioned manufacturing apparatus, for example, in the following manner.

First of all, the cylindrical support 2112 is installed within the reaction vessel 2111, and air in the vessel 2111 is discharged through a discharge device (for example, vacuum pump) (not shown). Then, the temperature of the cylindrical support 2112 is controlled by means of the support heater 2113 in such a manner that the temperature is maintained at a predetermined temperature of 200° to 350° C.

In order to flow the raw material gases for forming the deposit film into the reaction vessel 2111, after it is ascertained that the valves 2231–2236 of the gas bombs 2221–2226 and a leak valve 2117 of the reaction vessel 2111 are closed and the flow-in valves 2241–2246, flow-out valves 2251–2256 and auxiliary valve 2260 are opened, first of all, a main valve 2118 is opened to discharge air from the reaction vessel 2111 and a gas piping 2116.

Then, when a vacuum gauge 2119 indicates about $5\times10^{-6}$ Torr, the auxiliary valve 2260 and the flow-out valves 2251–2256 are closed. Thereafter, the gases are from the gas bombs 2221–2226 by opening the valves 2231–2236. In this case, a pressure of each gas is adjusted to 2 $Kg/cm^2$ by means of pressure regulators 2261–2266. Then, by gradually opening the flow-in valves 2241–2246, the gases are introduced into the mass flow controllers 2211–2216.

After the preparation for forming the film is completed in this way, various layers are formed in the following procedures.

When the temperature of the cylindrical support 2112 reaches the predetermined value, the required flow-out valves 2251–2256 and the auxiliary valve 2260 are gradually opened, so that the required gases are introduced from the corresponding gas bombs 2221–2226 into the reaction vessel 2111 through the gas introduction conduits 2114.

Then, the mass flow controllers 2211–2216 are adjusted to achieve the predetermined flow rate of the raw material gases. In this case, the opening degree of the main valve 2118 is adjusted so that the pressure in the reaction vessel 2111 becomes a predetermined value below 1 Torr while monitoring the indication of the vacuum gauge 2119. When the pressure in the vessel is stabilized, an RF power source (not shown) having a frequency of 13.56 MHz is set to provide desired electric power, and the RF electric power is introduced into the reaction vessel 2111 through the high frequency matching box 2115, thereby generating glow discharge. Due to the discharge energy, the raw material gases introduced in the reaction vessel 2111 are decomposed, so that a desired deposit film including silicon as main component is formed on the cylindrical support 2111. When a thickness of the film reaches a predetermined value, the supply of the RF electric power is stopped and the flow-out valves 2251–2256 are closed to stop the flow-in of the gas into the reaction vessel 2111, thereby finishing the formation of the deposit film.

By repeating similar operation by several times, a desired multilayer photosensitive layer 1102 is formed. It should be noted that, in forming each layer, the flow-in valves other than the required valve(s) are closed. Further, in order to prevent the gas from remaining in the reaction vessel 2111 and/or in the pipings between the reaction vessel 2111 and the flow-out valves 2251–2256, the flow-out valves 2251–2256 are closed, the auxiliary valve 2260 is opened and the main valve is also fully opened, thereby temporarily discharging the fluid from the apparatus completely by high vacuum.

In order to make the thickness of the film uniform, while the layer formation is being performed, it is desirable that the support 2112 is rotated at a predetermined speed by means of an appropriate drive mechanism (not shown). Further, it should be noted that the kinds of gasses and valves to be utilized may be changed in accordance with the layer forming condition.

Next, a method for manufacturing the electrophotographic photosensitive member formed by utilizing a high frequency plasma CVD method using VHF band as power source frequency (referred to as "VHF-PCVD method" hereinafter) will be explained.

Figure 3:
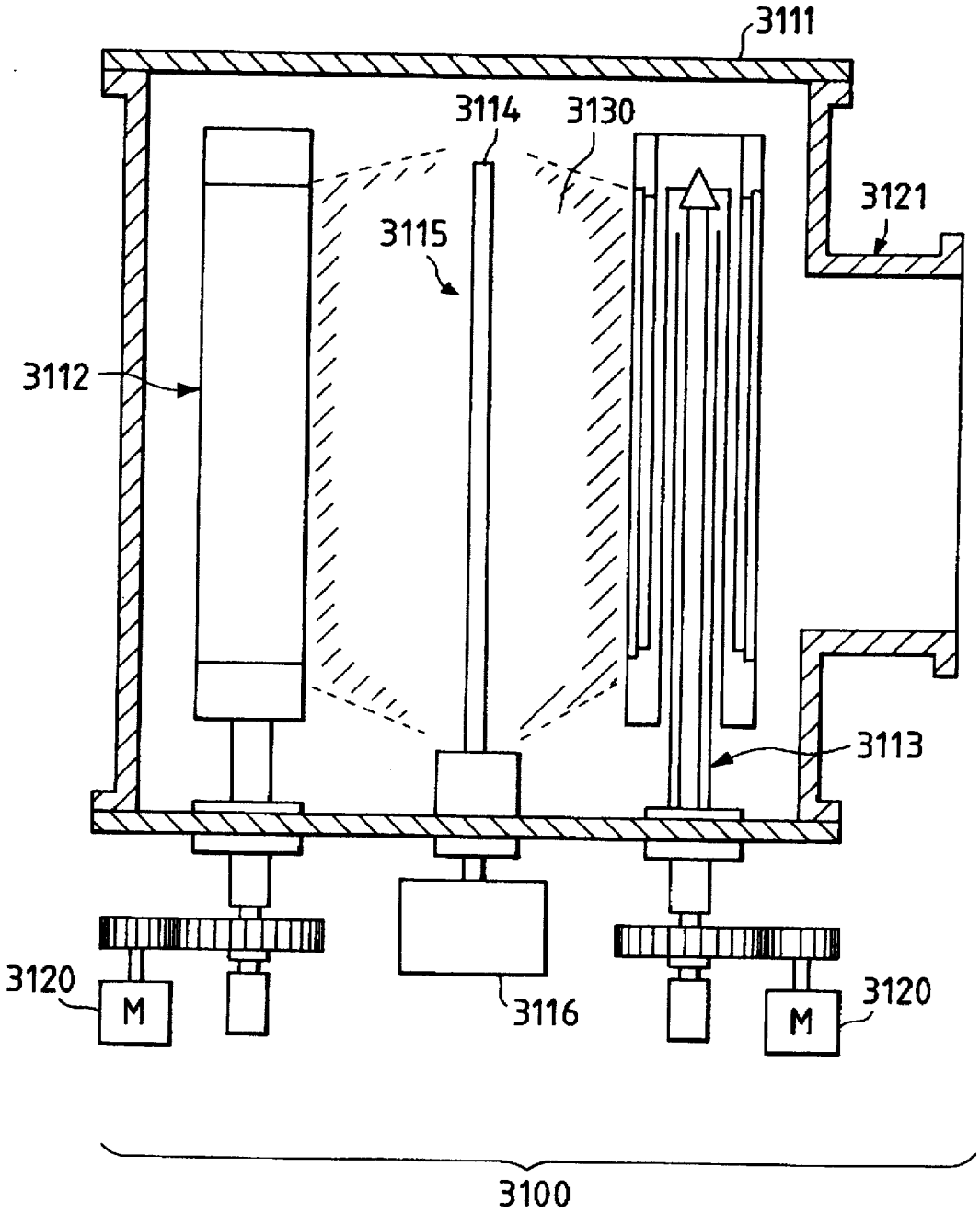
FIG. 3 is a schematic illustration for explaining a device for manufacturing an electrophotographic photosensitive member by means of a glow discharge method using high frequency wave having VHF band.

In place of the deposit device 2100 (for performing the RF-PCVD method) of the manufacturing apparatus shown in FIG. 2, by using a deposit device 3100 shown in FIG. 3 and by connecting this deposit device 3100 to the raw material gas supplying device 2200, an electrophotographic photosensitive member manufacturing apparatus for performing the VHF-PCVD method shown in FIG. 3 can be obtained.

This manufacturing apparatus generally comprises a reaction vessel 3111 of vacuum fluid-tight type wherein pressure in the vessel can be reduced, a raw material gas supplying device 2200, and a discharge device (not shown) for reducing pressure in a reaction vessel 3111. Cylindrical supports 3112, heaters 3113 for heating the supports, a raw material gas introduction conduit 3114 and an electrode 3115 are disposed within the reaction vessel 3111, and a high frequency matching box 3116 is connected to the electrode 3115. Further, the interior of the reaction vessel 3111 is connected to a diffusion pump (not shown) through a discharge pipe 3121.

The raw material gas supplying device 2200 is constituted by bombs 2221–2226 for containing raw material gases such as $SiH_4$, $GeH_4$, $H_2$, $CH_4$, $B_2H_6$ and $PH_3$, valves 2231–2236, 2241–2246, 2251–2256, and mass flow controllers 2211–2216, and the raw material gas bombs 2221–2226 are connected to the gas introduction conduit 3114 in the reaction vessel 3111 through a valve 2260. Further, a space 3130 surrounded by the cylindrical supports 3112 defines a discharging area.

The formation of the deposit film is performed by using the above-mentioned manufacturing apparatus for effecting the VHF-PCVD method, for example, in the following manner.

First of all, the cylindrical supports 3112 are installed within the reaction vessel 3111, the supports 3112 are rotated by drive mechanisms 3120 and air in the vessel 2111 is discharged through a discharge device (for example, vacuum pump) (not shown) to adjust the pressure in the reaction vessel 3111 to $1\times10^{-7}$ or less. Then, the temperature of the cylindrical support 3112 is controlled by means of the support heater 3113 in such a manner that the temperature is maintained at a predetermined temperature of 200° to 350° C.

In order to flow the raw material gases for forming the deposit film into the reaction vessel 3111, after it is ascertained that the valves 2231–2236 of the gas bombs 2221–2226 and a leak valve (not shown) of the reaction vessel 2111 are closed and the flow-in valves 2241–2246, flow-out valves 2251–2256 and auxiliary valve 2260 are opened, first of all, a main valve (not shown) is opened to discharge air from the reaction vessel 3111 and a discharge pipe 3121.

Then, when a vacuum gauge (not shown) indicates about $5\times10^{-6}$ Torr, the auxiliary valve 2260 and the flow-out valves 2251–2256 are closed. Thereafter, the gases are from the gas bombs 2221–2226 by opening the valves 2231–2236. In this case, a pressure of each gas is adjusted to 2 $Kg/cm^2$ by means of pressure regulators 2261–2266. Then, by gradually opening the flow-in valves 2241–2246, the gases are introduced into the mass flow controllers 2211–2216.

After the preparation for forming the film is completed in this way, various layers are formed on the cylindrical support 3111 in the following procedures.

When the temperature of the cylindrical support 3112 reaches the predetermined value, the required flow-out valves 2251–2256 and the auxiliary valve 2260 are gradually opened, so that the required gases are introduced from the corresponding gas bombs 2221–2226 into the discharging area 3130 in the reaction vessel 3111 through the gas introduction conduit 3114.

Then, the mass flow controllers 2211–2216 are adjusted to achieve the predetermined flow rate of the raw material gases. In this case, the opening degree of the main valve (not shown) is adjusted so that the pressure in the reaction vessel 3111 becomes a predetermined value below 1 Torr while monitoring the indication of the vacuum gauge (not shown). When the pressure in the vessel is stabilized, a VHF power source (not shown) having a frequency of 500 MHz is set to provide desired electric power, and the VHF electric power is introduced into the discharging area 3130 through the matching box 3116, thereby generating glow discharge.

In the charging area 3130 surrounded by the supports 3112, the introduced raw material gases are decomposed due to the discharge energy, so that a desired deposit film is formed on the cylindrical supports 3111. In this case, to make the thickness of the film uniform, the cylindrical supports are rotated at the predetermined speed by means of the corresponding drive mechanism 3120. When a thickness of the film reaches a predetermined value, the supply of the VHF electric power is stopped and the flow-out valves 2251–2256 are closed to stop the flow-in of the gas into the reaction vessel 3111, thereby finishing the formation of the deposit film.

By repeating similar operations by several times, a desired multilayer photosensitive layer 1102 is formed. It should be. noted that, in forming each layer, the flow-in valves other than the required valve(s) are closed. Further, in order to prevent the gas from remaining in the reaction vessel 3111 and/or in the pipings between the reaction vessel 3111 and the flow-out valves 2251–2256, the flow-out valves 2251–2256 are closed, the auxiliary valve 2260 is opened and the main valve (not shown) is also fully opened, thereby temporarily discharging the fluid from the apparatus completely by high vacuum. Incidentally, it should be noted that the kinds of gasses and valves to be utilized may be changed in accordance with the layer forming condition.

In any methods, during the formation of the deposit film, the temperature of the support 3112 should be set to 200° to 330° C., and preferably 250° to 300° C.

The support 3112 may be heated by any heat generating body (heater) operated under a vacuum condition. More specifically, an electric resistance heat generating body such as a sheath-shaped wound heater, a plate heater, a ceramic heater and the like, or a heat radiation lamp heat generating body such as a halogen lamp, an infrared ray lamp and the like, or a heat exchange heat generating body using liquid or gas may be used. The surface of the heat generating body may be formed from metal such as stainless steel, nickel, aluminum, copper and the like, or ceramics, or heat-resistive high molecular resin.

Alternatively, an additional vessel for heating the support may be provided so that, after heating, the support is moved within the reaction vessel under a vacuum condition.

Further, particularly, in the VHF-PCVD method, it is desirable that the pressure in the discharging area is set to 1 to 500 mTorr, preferably 3 to 300 mTorr, and more preferably 5 to 100 mTorr.

In the VHF-PCVD method, dimension and configuration of the electrode disposed within the discharging area can be appropriately selected so long as the discharge is not disturbed or distorted, but, in practice, a cylindrical shape having a diameter of 1 mm to 10 cm is preferable. In this case, a length of the electrode can also be appropriately selected so long as the electric field acts on the support uniformly. The electrode may have a conductive surface, and may be made of metal such as stainless steel, aluminum (Al), chromium (Cr), molybdenum (Mo), gold (Au), indium (In), niobium (Nb), tellurium (Te), vanadium (V), titanium (Ti), platinum (Pt), iron (Fe) and the like or their alloys, or may be formed from glass, ceramic or plastic each of which has a surface subjected to conductor treatment.

As mentioned above, according to the present invention, different from the conventional system wherein moisture is removed at a relatively low temperature avoiding degeneration of the photosensitive member for a long time with relatively low electric power, by utilizing a system obtained by combination of the re-usable toner, the improved heater and the improved photosensitive member, i.e. a moisture removing system of the electrophotographing apparatus wherein very high temperature is applied to the photosensitive member for a short time in the toner re-using system, the excellent image stabilization can be achieved.

By constructing the electrophotographic photosensitive member according to the present invention as mentioned above, it is possible to eliminate the various drawbacks caused by the conventional electrophotographic photosensitive members constituted by OPC and a—Si, and, in the toner re-using system, the excellent electrical feature, optical feature, photo-conductive feature, image feature, durability and usage environmental feature can be achieved.

Next, the advantages of the present invention will be concretely explained with reference to embodiments thereof.

<Embodiment 1>

An aluminum cylinder having an outer diameter of 80 mm and a length of 358 mm was used as a substrate, and 5% methanol solution of alkoxy-methylation nylon was coated on the substrate by a dipping method to form an under coating layer (intermediate layer) having a film thickness of 1 μm or less. Then, titanilphthalocyanine pigment of 10 parts by weight, polyvinylbutyral of 8 parts by weight and cyclohexanone of 50 parts by weight were mixed and dispersed by a sand mill device using glass beads (each having a diameter of 1 mm) of 100 parts by weight for 20 hours. Methyl ethyl ketone of 70 to 120 parts by weight were added to the dispersed solution, and the obtained solution was coated on the under coating layer, which was then dried at a temperature of 100° C. for 5 minutes, thereby forming the charge generating layer having a thickness of 0.2 μm.

Then, styril compound (having the following constitutional formula) of 10 parts by weight and bisphenol-Z-polycarbonate of 10 parts by weight were dissolved in monochlorobenzene of 65 parts by weight. The solution was coated on the charge generating layer by the dipping method, which was then heat-blow dried at a temperature of 120° C. for 60 minutes, thereby forming the charge transfer layer having a thickness of 20 μm.

Then, the protection layer having a thickness of 10 μm was formed on the charge transfer layer in the following manner. That is, (A) high melting point polyethylene terephthalate [having limiting viscosity of 0.70 dl/g, melting point of 258° C. (measured at a temperature increasing speed of 10° C./min by using a differential calory measuring device. Incidentally, sample of 5 mg to be measured was obtained by melting polyester resin (to be measured) at a temperature of 280° C. and then by quickly cooling the molten resin by using iced water. The same in the following embodiments described later), glass transition temperature of 70° C.] of 100 parts by weight, and (B) epoxy resin [epoxy equivalent of 160; aromatic ester type; commercial name: EPICOAT 190P (manufactured by Yuka Shell Epoxy Inc.)] of 30 parts by weight were dissolved into a mixed solution of phenol and tetrachloroethane (1:1). Then, (C) triphenyl-sulfonium-hexafluoro-antimonate of 3 parts by weight was added as photopolymerization starting agent, thereby preparing resin composition solution.

Light emitted from a 2 KW high voltage mercury lamp (30 W/cm) spaced apart from the prepared solution by a distance of 20 cm was illuminated onto the solution at a temperature of 130° C. for 8 seconds to cure the solution. The photosensitive member manufactured in this way was mounted in a copying machine [commercial name: NP-4050 (manufactured by Canon Inc.)] which was remodelled to permit addition of an external heater and an internal heater for the photosensitive member and to permit the collection and re-use of toner. Then, by using this copying machine, endurance test for obtaining 200000 copies was performed at a temperature of 24° C. and humidity of 55% under the heater setting conditions shown in the following Tables 1 to 3. Further, after the endurance test, the copying machine left as it was under high temperature/high humidity condition (temperature of 32° C. and humidity of 80%) all night. Then, image evaluation was effected. Test results are shown in the Tables 1 to 3.

TABLE 1

| Test example | | temperature dependency %/deg | temperature difference A deg | image diagnosis (high humidity image flow/image injury/ sleeve pitch unevenness) | power consumption | judgment |
|---|---|---|---|---|---|---|
| Embodiment 1 | inner surface heater | 0.3 | −5 | ○/○/X | X | X |
| | inner surface heater | 0.3 | −1 | Δ/○/X | Δ | Δ |
| | inner surface heater | 0.3 | −0.5 | X/○/X | Δ | Δ |
| | external heater B | 0.3 | 0.5 | Δ/○/○ | ○ | Δ |
| | external heater B | 0.3 | 1 | ○/○/○ | ○ | ○ |
| | external heater A | 0.3 | 5 | ○/○/○ | ○ | ○ |
| | external heater A | 0.3 | 10 | ○/○/○ | ○ | ○ |
| | external heater A | 0.3 | 105 | ○/X/Δ | X | X |

TABLE 1-continued

| Test example | | temperature dependency %/deg | temperature difference A deg | image diagnosis (high humidity image flow/image injury/ sleeve pitch unevenness) | power consumption | judgment |
|---|---|---|---|---|---|---|
| Comparison example 1 | inner surface heater | 0.3 | −5 | ○/○/X | X | X |
| | inner surface heater | 0.3 | −1 | Δ/○/X | Δ | X |
| | inner surface heater | 0.3 | −0.5 | X/○/X | Δ | X |
| | external heater B | 0.3 | 0.5 | ○/○/○ | ○ | Δ |
| | external heater B | 0.3 | 1 | ○/X/○ | ○ | ○ |
| | external heater A | 0.3 | 5 | ○/X/○ | ○ | Δ |
| | external heater A | 0.3 | 10 | ○/X/○ | ○ | Δ |
| | external heater A | 0.3 | 105 | ○/X/Δ | X | X |
| Comparison example 2 | inner surface heater | 0.3 | −5 | ○/○/X | X | X |
| | inner surface heater | 0.3 | −1 | Δ/○/X | Δ | X |
| | inner surface heater | 0.3 | −0.5 | X/○/X | Δ | X |
| | external heater B | 0.3 | 0.5 | ○/○/○ | ○ | Δ |
| | external heater B | 0.3 | 1 | ○/○/○ | ○ | ○ |
| | external heater A | 0.3 | 5 | ○/X/○ | ○ | Δ |
| | external heater A | 0.3 | 10 | ○/X/○ | ○ | Δ |
| | external heater A | 0.3 | 105 | ○/X/Δ | X | X |

TABLE 2

| Test example | | temperature dependency %/deg | photosensitive member temperature increase deg/min | proximity temperature increase deg/min | temperature difference C deg | image diagnosis (high humidity image flow/image injury/ deposit | power consumption | judgment |
|---|---|---|---|---|---|---|---|---|
| Embodiment 1 | inner surface heater | 0.3 | 0.7 | 0.6 | 1 | ○/○/X | X | X |
| | inner surface heater | 0.3 | 0.7 | 0.4 | 3 | Δ/○/○ | Δ | Δ |
| | inner surface heater | 0.3 | 0.7 | 0.3 | 4 | Δ/○/○ | Δ | Δ |
| | external heater B | 0.3 | 0.7 | 0.1 | 6 | Δ/○/○ | ○ | Δ |
| | external heater B | 0.3 | 0.7 | 0.2 | 5 | ○/○/○ | ○ | ○ |
| | external heater A | 0.3 | 0.7 | 0.4 | 3 | ○/○/○ | ○ | ○ |
| | external heater A | 0.3 | 0.7 | 0.5 | 5 | ○/○/Δ | ○ | Δ |
| | external heater A | 0.3 | 0.7 | 1.0 | −5 | ○/X/X | X | X |
| Comparison example 1 | inner surface heater | 0.3 | 0.7 | 0.6 | 1 | ○/○/X | X | X |
| | inner surface heater | 0.3 | 0.7 | 0.4 | 3 | Δ/○/○ | Δ | Δ |
| | inner surface heater | 0.3 | 0.7 | 0.3 | 4 | Δ/○/○ | Δ | Δ |
| | external heater B | 0.3 | 0.7 | 0.1 | 6 | Δ/○/○ | ○ | Δ |
| | external heater B | 0.3 | 0.7 | 0.2 | 5 | ○/Δ○ | ○ | Δ |
| | external heater A | 0.3 | 0.7 | 0.4 | 3 | ○/X/○ | ○ | Δ |
| | external heater A | 0.3 | 0.7 | 0.5 | 5 | ○/X/Δ | ○ | X |
| | external heater A | 0.3 | 0.7 | 1.0 | −5 | ○/X/X | X | X |
| Comparison example 2 | inner surface heater | 0.3 | 0.7 | 0.6 | 1 | ○/○/X | X | X |
| | inner surface heater | 0.3 | 0.7 | 0.4 | 3 | Δ/○/○ | Δ | Δ |
| | inner surface heater | 0.3 | 0.7 | 0.3 | 4 | X/○/○ | Δ | Δ |
| | external heater B | 0.3 | 0.7 | 0.1 | 6 | ○/○/○ | ○ | Δ |
| | external heater B | 0.3 | 0.7 | 0.2 | 5 | ○/○/○ | ○ | ○ |
| | external heater A | 0.3 | 0.7 | 0.4 | 3 | ○/X○ | ○ | Δ |
| | external heater A | 0.3 | 0.7 | 0.5 | 5 | ○/X/Δ | ○ | X |
| | external heater A | 0.3 | 0.7 | 1.0 | −5 | ○/X/X | X | X |

TABLE 3

| Test example | | temperature dependency %/deg | increased temperature of photo-sensitive member deg | image diagnosis (high humidity image flow/image injury/ deposit) | power consumption | judgment |
|---|---|---|---|---|---|---|
| Embodiment 1 | inner surface heater | 0.3 | +1 | X/○/X | X | X |
| | inner surface heater | 0.3 | +0.5 | X/○/○ | X | X |
| | inner surface heater | 0.3 | 0 | X/○/○ | Δ | Δ |
| | external heater B | 0.3 | 0 | X/○/○ | ○ | Δ |
| | external heater B | 0.3 | +0.5 | ○/○/○ | ○ | ○ |
| | external heater A | 0.3 | +1 | ○/○/○ | ○ | ○ |
| | external heater A | 0.3 | +2 | ○/○/Δ | ○ | Δ |
| | external heater A | 0.3 | +5 | ○/○/X | X | X |

TABLE 3-continued

| Test example | | temperature dependency %/deg | increased temperature of photo-sensitive member deg | image diagnosis (high humidity image flow/image injury/ deposit) | power consumption | judgment |
|---|---|---|---|---|---|---|
| Comparison example 1 | inner surface heater | 0.3 | +1 | X/○/X | X | X |
| | inner surface heater | 0.3 | +0.5 | X/○/○ | X | X |
| | inner surface heater | 0.3 | 0 | X/○/○ | Δ | Δ |
| | external heater B | 0.3 | 0 | X/○/○ | ○ | Δ |
| | external heater B | 0.3 | +0.5 | ○/○/○ | ○ | ○ |
| | external heater A | 0.3 | +1 | X/Δ/○ | ○ | Δ |
| | external heater A | 0.3 | +2 | X/X/Δ | ○ | X |
| | external heater A | 0.3 | +5 | X/X/X | X | X |
| Comparison example 2 | inner surface heater | 0.3 | +1 | X/○/X | X | X |
| | inner surface heater | 0.3 | +0.5 | X/○/○ | X | X |
| | inner surface heater | 0.3 | 0 | X/○/○ | Δ | Δ |
| | external heater B | 0.3 | 0 | X/○/○ | ○ | Δ |
| | external heater B | 0.3 | +0.5 | ○/○/○ | ○ | ○ |
| | external heater A | 0.3 | +1 | Δ/Δ/○ | ○ | Δ |
| | external heater A | 0.3 | +2 | X/X/Δ | ○ | X |
| | external heater A | 0.3 | +5 | X/X/X | X | X |

Figure 1:
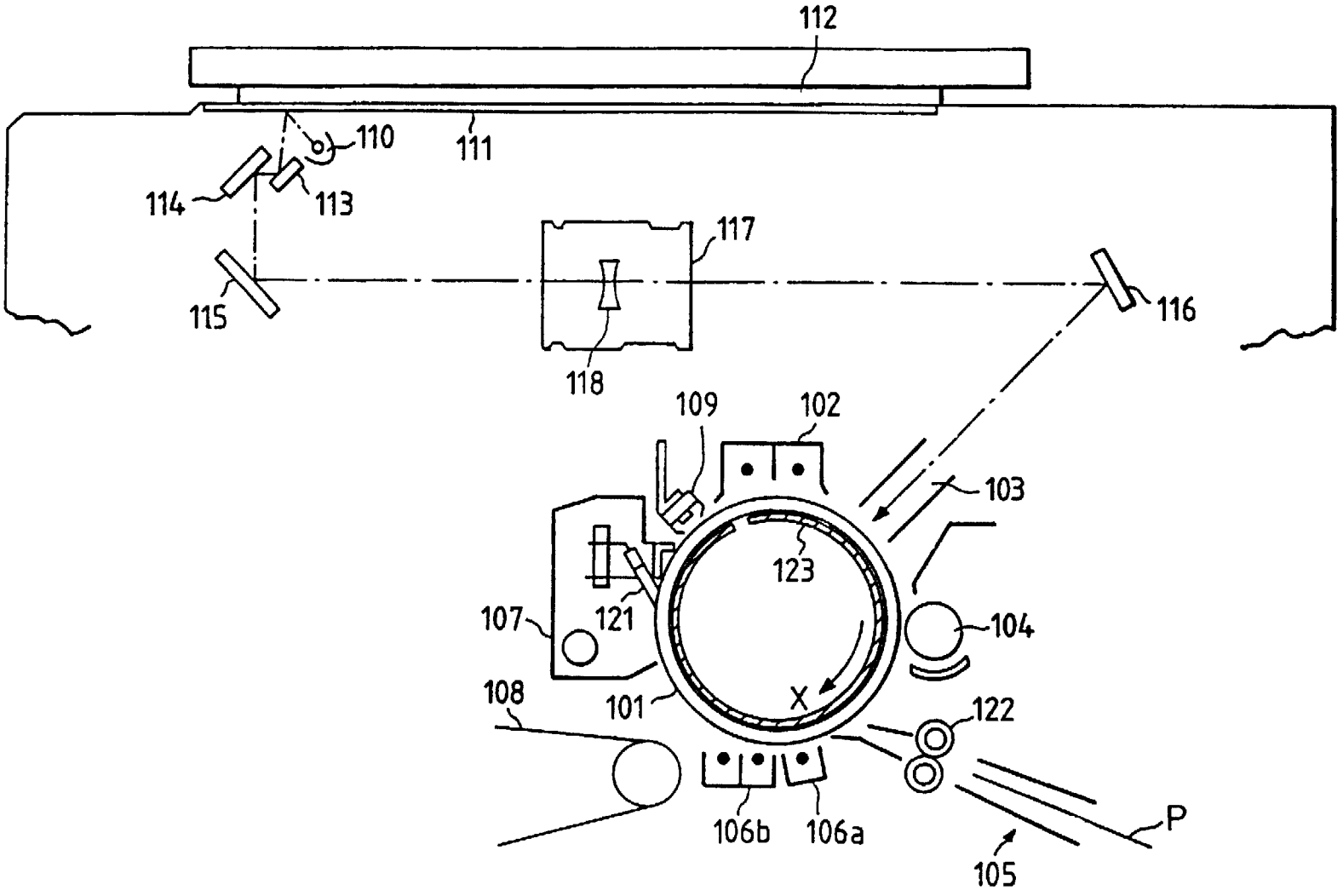
FIG. 1 is a schematic illustration for explaining an electrophotographing apparatus.

In the Tables 1 to 3, regarding the temperature dependency, when a certain receptive amount is given, i.e. when given voltage is applied to the main chargers 102 and 402 (FIGS. 1 and 4), the potential on the photosensitive member is successively measured as the temperature of the photosensitive member is changed between 25° C. (room temperature) and 45° C., and, the change in potential per 1° C. is calculated. In this case, the temperature dependency is represented by a change ratio of the calculated potential change with respect to the receptive potential. More specifically, 0.5%/deg means that, when dark receptive potential is 600 V, 3 V/deg was obtained.

In the Table 1, regarding the temperature difference A, the temperature of the surface of the photosensitive member and the temperature of a back surface of the substrate were measured by a thermocouple. In this case, the temperature difference is represented by a difference in temperature of these surfaces when the temperature of the back surface of the substrate reaches (room temperature +10° C.) after the heating is started [(photosensitive member surface temperature °C.)—(substrate back surface temperature °C.)]. The temperature of the back surface of the substrate was adjusted to 40° C., and the image was outputted under a condition wherein the heater is energized in such a manner that the temperature increase of the surface of the photosensitive member becomes greater than the back surface temperature increase of the substrate. In the image diagnosis, high humidity image flow, image injury or image defect due to the damage on the surface of the photosensitive member caused by the heat from the heater, and image density unevenness due to thermal eccentricity of the developing sleeve were evaluated. Regarding the power consumption, electric power consumed by the heater was evaluated. Regarding the synthetic judgment, it was judged whether the objects of the present invention can be achieved or not on the basis of the above results. In the Table 1, a symbol ○ indicates "excellent", a symbol Δ indicates "no problem in practical use", and a symbol x indicates "bad".

As a result, by controlling a heat source disposed near the surface of the photosensitive member in such a manner that the temperature increase of the surface of the photosensitive member becomes greater than the temperature increase of the back surface of the substrate and the temperature difference between the surface of the photosensitive member (the temperature of which is greater than the temperature of the back surface of the substrate) and the back surface of the substrate has a temperature gradient of 1 to 100 (deg/sec), the good image without high humidity image flow and image density unevenness due to the thermal eccentricity of the developing sleeve could be obtained. This effect was notable particularly when an external heater A having a heat generating sintered body provided on an elongated ceramic substrate was used as the heat source.

In the Table 2, the temperature of the surface of the photosensitive member was adjusted to 40° C. and the temperature near a cleaner of the remodelled copying machine [commercial name: NP-4050 (manufactured by Canon Inc.)] was measured, and the image was outputted under a condition wherein the heater is energized in such a manner that the surface temperature increase becomes greater than the temperature increase near the cleaner. Regarding the temperature difference B, the temperature of the surface of the photosensitive member and the temperature near the cleaner were measured by a thermocouple. In this case, the temperature difference was represented by a difference in temperature when the temperature of the surface of the photosensitive member reaches (room temperature +10° C.) after the heating is started [(photosensitive member surface temperature increase °C.)—(temperature increase °C. near the photosensitive member)]. In the image diagnosis, high humidity image flow, image injury due to the damage on the surface of the photosensitive member, and image defect due to toner fusion were evaluated. Regarding the power consumption, electric power consumed by the heater was evaluated. Regarding the synthetic judgment, it was judged whether the objects of the present invention can be achieved or not on the basis of the above results. A symbol ○ indicates "excellent", a symbol Δ indicates "no problem in practical use", and a symbol x indicates "bad".

As a result, by controlling a heat source disposed near the surface of the photosensitive member in such a manner that the temperature increase of the surface of the photosensitive member becomes greater than the temperature increase near the photosensitive member, the good image without high humidity image flow and toner deposit could be obtained. Particularly, when an external heater A having a heat generating sintered body provided on an elongated ceramic substrate was used as the heat source, the temperature increase of the cleaner could be suppressed effectively to notable effect.

In the Table 3, the temperature of the photosensitive member was not adjusted and, regarding a single copy (one copy) treated by the remodelled copying machine [commercial name: NP-4050 (manufactured by Canon Inc.)], the pre-rotation period was set to 10 seconds and time period from start to discharge was set to 15 seconds, and the image was outputted under a condition wherein the heater is energized during only the above periods. In the image diagnosis, high humidity image flow, image injury or image defect due to the damage on the surface of the photosensitive member caused by the heat from the heater, and image defect due to toner deposit were evaluated. Regarding the power consumption, electric power consumed by the heater was evaluated. Regarding the synthetic judgment, it was judged whether the objects of the present invention can be achieved or not on the basis of the above results. A symbol ○ indicates "excellent", a symbol Δ indicates "no problem in practical use", and a symbol x indicates "bad".

As a result, by controlling a heat source disposed near the surface of the photosensitive member in such a manner that the temperature difference between the surface of the photosensitive member (the temperature of which is greater than the temperature of the back surface of the substrate) and the back surface of the substrate has a temperature gradient of 1 to 100 (deg/sec), regardless of the very short heating time, the good image without high humidity image flow could be obtained, and the toner deposit was not generated because of the short heating time. This effect was notable particularly when an external heater A having a heat generating sintered body provided on an elongated ceramic substrate was used as the heat source.

(Comparison example 1)

A photosensitive member similar to that of the Embodiment 1 except for omission of the protection layer was manufactured, and the endurance test similar to that of the Embodiment 1 was performed. A test result is shown in Tables 1 to 4.

TABLE 4

| | charge injection preventing layer | photo-conductive layer | surface layer |
|---|---|---|---|
| gas kind & flow rate | | | |
| $SiH_4$ [SCCM] | 100 | 200 | 10 |
| $H_2$ [SCCM] | 300 | 800 | |
| $B_2H_6$ [PPM] (for $SiH_4$) | 2000 | 2 | |
| NO [SCM] | 50 | | |
| $CH_4$ [SCCM] | | | 500 |
| support temperature [°C.] | 290 | 290 | 290 |
| inner pressure [Torr] | 0.5 | 0.5 | 0.5 |
| power [W] | 500 | 800 | 300 |
| film thickness [μm] | 3 | 30 | 0.5 |

(Comparison example 2)

In place of the protection layer of the Embodiment 1, as the same binder as that used in the manufacture of the charge transfer layer, bisphenol-Z-polycarbonate of 4 parts by weight, monochlorobenzene of 70 parts by weight and PTFE fine powder of 1 part by weight were mixed and dispersed by a sand mill device for 10 hours to obtain coating liquid. Then, the coating liquid was coated on the charge transfer layer by a spraying method to have a thickness of 1.0 μm, thereby forming a protection layer. The endurance test similar to that of the Embodiment 1 was performed. A test result is shown in the Tables 1 to 3.

<Embodiment 2>

By using the manufacturing apparatus for manufacturing the electrophotographic photosensitive member by means of the RF-PCVD method shown in FIG. 2, the photosensitive member having the charge injection preventing layer, photo-conductive layer and surface layer was formed on an aluminium cylinder having a diameter of 108 mm and subjected to mirror surface treatment, in accordance with the conditions shown in the Table 4. Further, a plurality of such photosensitive members were manufactured by changing the ratio between $SiH_4$ and $H_2$ in the photo-conductive layer and the discharge electric power. The manufactured photosensitive member was mounted in an electrophotographing apparatus which was remodelled to permit addition of an external heater and an internal heater for the photosensitive member and to permit the collection and re-use of toner (a copying machine of Model No. NP-6060 manufactured by Canon Inc. was remodelled for text use). Then, by using this apparatus, the temperature dependency (temperature characteristic) of the charging ability, memory and image defect were evaluated.

Regarding the temperature characteristic, the charging ability was successively measured as the temperature of the photosensitive member was changed between 25° C. (room temperature) and about 45° C., and, the change in the charging ability per a temperature of 1° C. was calculated. In this case, the temperature characteristic was judged as allowable when the receptive potential was |0.5%/deg| or below. More specifically, in case of the dark receptive potential of 400 V, when |2 V/deg| or less was reached, the temperature characteristic was judged as allowable. Further, regarding the memory and the image flow, the image was visually judged to obtain the following four ranks: (1) very good, (2) good, (3) no problem in practical use, and (4) hard to put to practical use.

Figure 5:
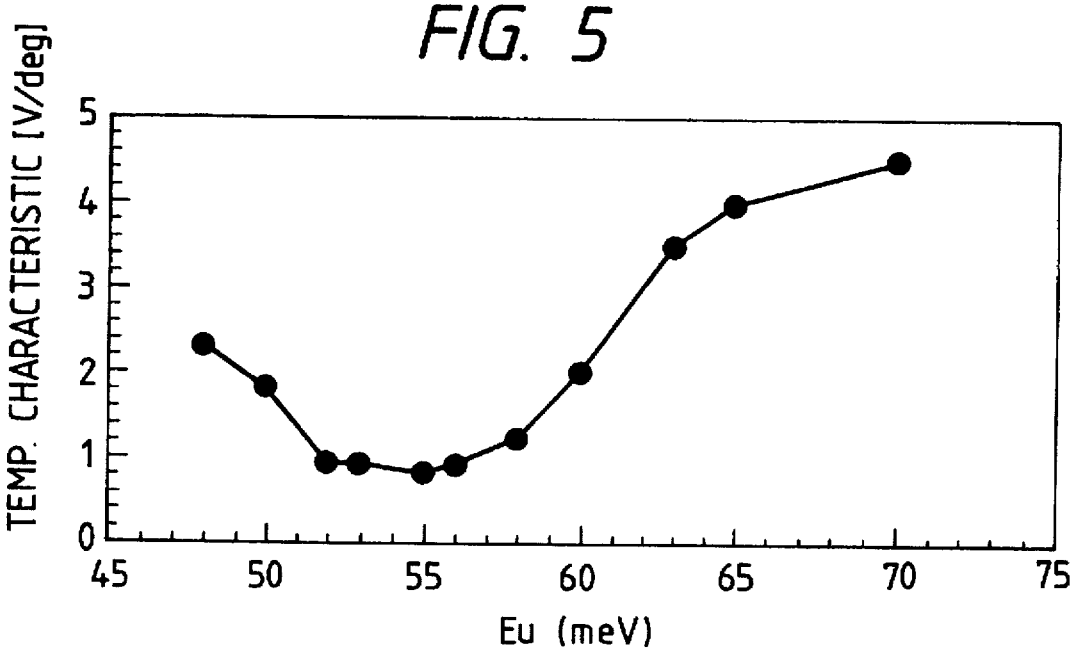
FIG. 5 is a graph showing a relation between arback tail property energy (Eu) and temperature characteristic of a photo-conductive layer of an electrophotographic photosensitive member.
Figure 6:
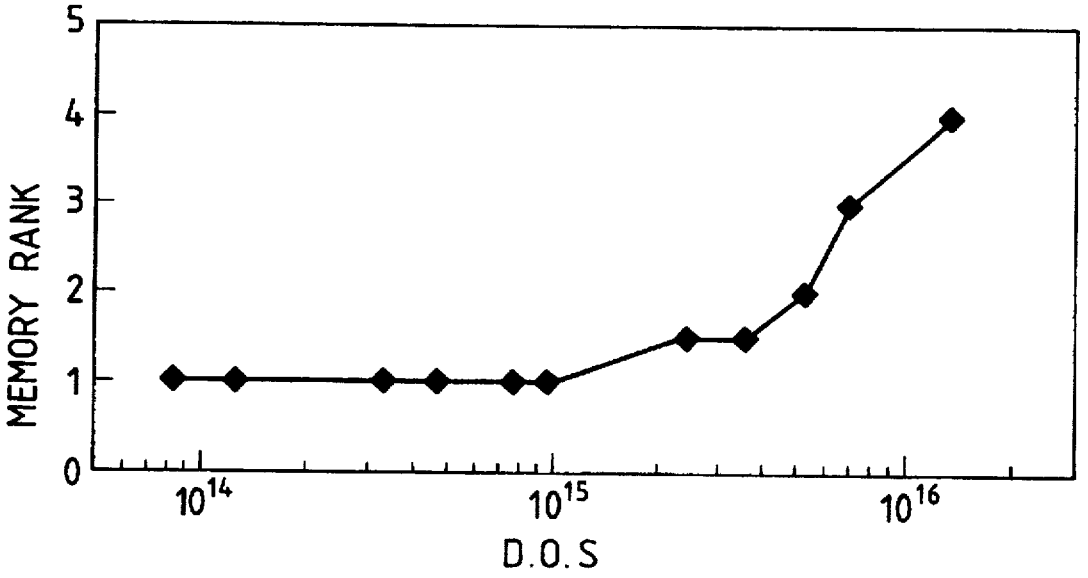
FIG. 6 is a graph showing a relation between local condition density (DOS) and optical memory of a photo-conductive layer of an electrophotographic photosensitive member according to the present invention.
Figure 7:
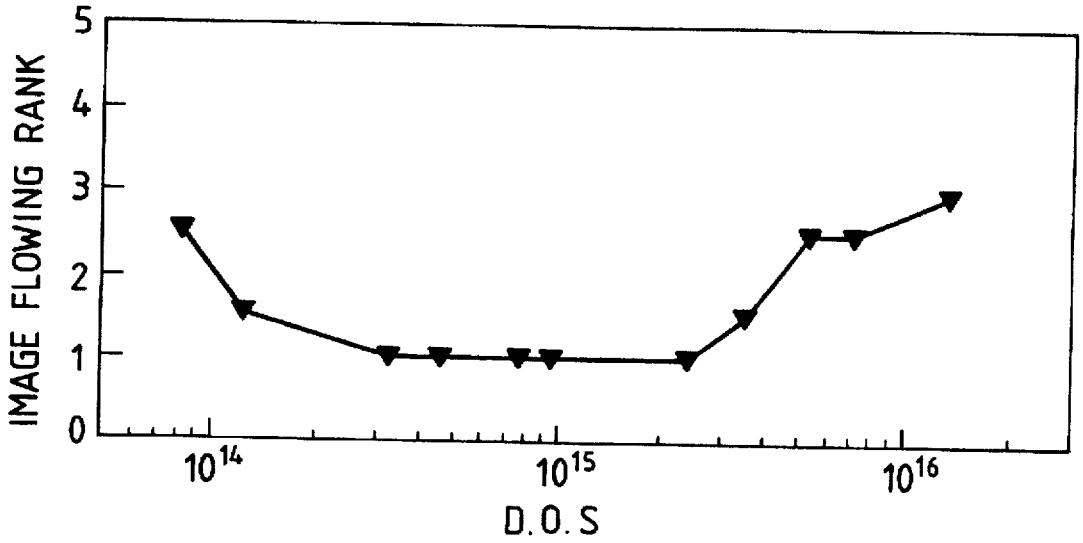
FIG. 7 is a graph showing a relation between local condition density (DOS) and image flow of the photo-conductive layer of the electrophotographic photosensitive member according to the present invention.
Figure 8:
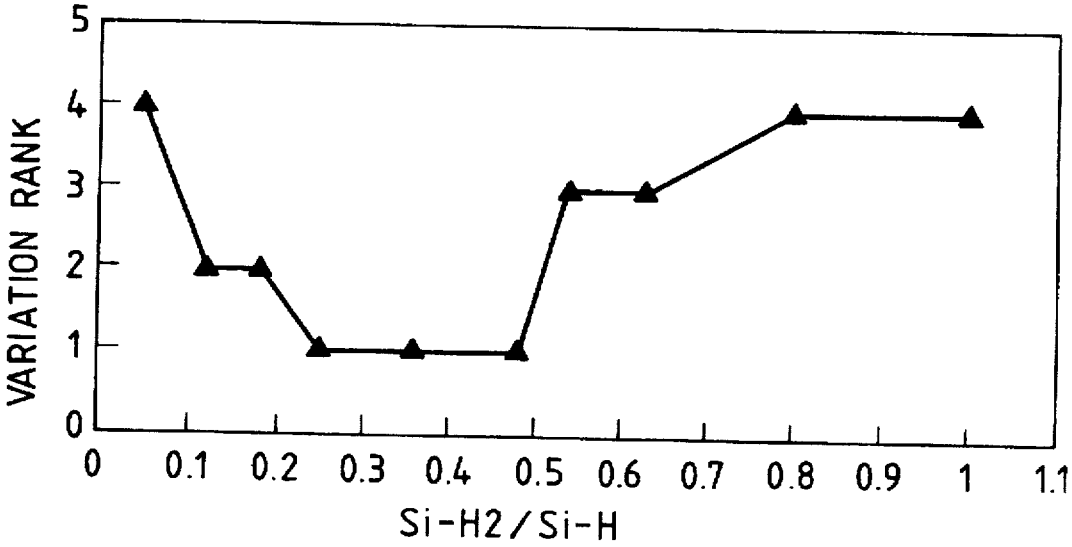
FIG. 8 is a graph showing a relation between absorption peak strength ratio of Si—$H_2$ linkage and half tone density unevenness (variation) of the photo-conductive layer of the electrophotographic photosensitive member according to the present invention.

On the other hand, a—Si deposit film having a thickness of about 1 μm was formed on a glass substrate (Commercial No.: 7059; manufactured by Corning Inc.) and a silicon wafer rested on a circular sample holder in accordance with the photo-conductive layer forming condition. An A□ split-type electrode was adhered to the deposit film on the glass substrate by vapor deposition treatment. Feature energy (Eu) of an exponential function tail and local level density (D.O.S) were measured by CPM, and hydrogen content of the deposit film on the silicon wafer was measured by FTIP. In this regard, a relation between Eu and the temperature characteristic is shown in FIG. 5, a relation between D.O.S and the memory is shown in FIG. 6, and a relation between D.O.S and the image flow is shown in FIG. 7. Regarding all of samples, the hydrogen content was 10 to 30 atomic %. As apparent from FIGS. 5 to 8, it was found that, in order to obtain the good electrophotographic feature, Eu=50 to 60 meV and D.O.S=$1\times10^{14}$ to $5\times10^{15}$ $cm^{-3}$ must be satisfied.

Regarding the photosensitive members having various electrophotographic features and different temperature characteristics, by using the above-mentioned electrophotographing apparatus (a copying machine of Model No. NP-6060 manufactured by Canon Inc. was remodelled for text use) within which an inner surface heater, external heater A and external heater B were mounted, endurance tests for forming 200000 copies were performed under a test environment having a temperature of 24° C. and relative humidity of 55% in accordance with the respective heater setting conditions. Further, after the endurance test, the copies left as they were under high temperature/high humidity condition (temperature of 32° C. and humidity of 80%) all night. Then, image evaluation was effected. Test results regarding the improved effects of the image flow and the like are shown in Tables 5A to 12B.

TABLE 5A

| Test example | | temperature difference A | power consumption | temperature characteristic & image diagnosis (high humidity image flow) −2.8 | −1.2 | 0.6 | 1.4 | 2.2 | 3.4 | 4.5 |
|---|---|---|---|---|---|---|---|---|---|---|
| Embodiment 2 | inner surface heater | −5 | X | ○ | ○ | ○ | ○ | ○ | ○ | ○ |
| | inner surface heater | −1 | Δ | Δ | Δ | Δ | Δ | Δ | Δ | Δ |
| | inner surface heater | −0.5 | Δ | X | X | X | X | X | X | X |
| | external heater B | −0.5 | ○ | ○ | ○ | ○ | ○ | ○ | ○ | ○ |
| | external heater B | 1 | ○ | ○ | ○ | ○ | ○ | ○ | ○ | ○ |
| | external heater A | 5 | ○ | ○ | ○ | ○ | ○ | ○ | ○ | ○ |
| | external heater A | 10 | ○ | ○ | ○ | ○ | ○ | ○ | ○ | ○ |
| | external heater A | 105 | X | ○ | ○ | ○ | ○ | ○ | ○ | ○ |

TABLE 5B

| Test example | | temperature difference A | power consumption | temperature characteristic & image diagnosis (image density change [temperature characteristic]) −2.8 | −1.2 | 0.6 | 1.4 | 2.2 | 3.4 | 4.5 |
|---|---|---|---|---|---|---|---|---|---|---|
| Embodiment 2 | inner surface heater | −5 | X | X | Δ | Δ | Δ | X | X | X |
| | inner surface heater | −1 | Δ | X | Δ | Δ | Δ | Δ | Δ | X |
| | inner surface heater | −0.5 | Δ | ○ | ○ | ○ | ○ | ○ | ○ | ○ |
| | external heater B | −0.5 | ○ | ○ | ○ | ○ | ○ | ○ | ○ | ○ |
| | external heater B | 1 | ○ | Δ | ○ | ○ | ○ | Δ | Δ | X |
| | external heater A | 5 | ○ | Δ | ○ | ○ | ○ | Δ | Δ | X |
| | external heater A | 10 | ○ | Δ | ○ | ○ | ○ | Δ | X | X |
| | external heater A | 105 | X | X | X | X | X | X | X | X |

TABLE 5C

| Test example | | temperature difference A | power consumption | temperature characteristic & image diagnosis (image density change [peripheral unevenness]) −2.8 | −1.2 | 0.6 | 1.4 | 2.2 | 3.4 | 4.5 |
|---|---|---|---|---|---|---|---|---|---|---|
| Embodiment 2 | inner surface heater | −5 | X | X | Δ | Δ | Δ | X | X | X |
| | inner surface heater | −1 | Δ | X | Δ | Δ | Δ | Δ | Δ | X |
| | inner surface heater | −0.5 | Δ | ○ | ○ | ○ | ○ | ○ | ○ | ○ |
| | external heater B | −0.5 | ○ | ○ | ○ | ○ | ○ | ○ | ○ | ○ |
| | external heater B | 1 | ○ | Δ | ○ | ○ | ○ | Δ | Δ | X |
| | external heater A | 5 | ○ | Δ | ○ | ○ | ○ | Δ | Δ | X |
| | external heater A | 10 | ○ | Δ | ○ | ○ | ○ | Δ | X | X |
| | external heater A | 105 | X | X | X | X | X | X | X | X |

In the Tables 5A to 5C, the temperature of the photosensitive member is adjusted to 40° C., and, regarding the temperature difference A, the temperature of the surface of the photosensitive member and the temperature of a back surface of the substrate were measured by a thermocouple. In this case, the temperature difference is represented by a difference in temperature of these surfaces when the temperature of the back surface of the substrate reaches |room temperature +10° C.| after the heating is started [(photosensitive member surface temperature °C.)—(substrate back surface temperature °C.)]. The temperature of the back surface of the substrate was adjusted to 40° C., and the image was outputted under a condition wherein the heater is energized in such a manner that the temperature increase of the surface of the photosensitive member becomes greater than the back surface temperature increase of the substrate. In the image diagnosis, high humidity image flow, potential change due to the change in temperature of the surface of the photosensitive member caused by the heat from the heater, i.e. image density change due to the temperature characteristic, and image density unevenness due to thermal eccentricity of the developing sleeve were evaluated. Regarding the power consumption, electric power consumed by the heater was evaluated. A symbol ○ indicates "excellent", a symbol Δ indicates "no problem in practical use", and a symbol x indicates "bad".

As a result, by controlling a heat source disposed near the surface of the photosensitive member in such a manner that the temperature dependency at the temperature of 25° to 45° C. (of the surface of the photosensitive member) becomes |0.5%/deg| of the receptive potential and the temperature increase of the surface of the photosensitive member becomes greater than the temperature increase of the back surface of the substrate and the temperature difference between the surface of the photosensitive member (the temperature of which is greater than the temperature of the back surface of the substrate) and the back surface of the substrate has a temperature gradient of 1 to 100 (deg/sec), the good results regarding the high humidity image flow, temperature change, and density unevenness due to the thermal eccentricity of the developing sleeve could be obtained. This effect was notable particularly when an external heater A having a heat generating sintered body provided on an elongated ceramic substrate was used as the heat source.

Similarly, by differentiating the temperature increase of the surface of the photosensitive member from the temperature increase near the cleaner, the test results regarding improvement in the image flow and toner deposit are shown in Tables 6A and 6B.

TABLE 6A

| Test example | | temperature difference B | power consumption | temperature characteristic & image diagnosis (high humidity image flow) −2.8 | −1.2 | 0.6 | 1.4 | 2.2 | 3.4 | 4.5 |
|---|---|---|---|---|---|---|---|---|---|---|
| Embodiment 2 | inner surface heater | 1 | X | ○ | ○ | ○ | ○ | ○ | ○ | ○ |
| | inner surface heater | 3 | Δ | Δ | Δ | Δ | Δ | Δ | Δ | Δ |
| | inner surface heater | 4 | Δ | X | X | X | X | X | X | X |
| | external heater B | 6 | ○ | ○ | ○ | ○ | ○ | ○ | ○ | ○ |
| | external heater B | 5 | ○ | ○ | ○ | ○ | ○ | ○ | ○ | ○ |
| | external heater A | 3 | ○ | ○ | ○ | ○ | ○ | ○ | ○ | ○ |
| | external heater A | 5 | ○ | ○ | ○ | ○ | ○ | ○ | ○ | ○ |
| | external heater A | −5 | X | ○ | ○ | ○ | ○ | ○ | ○ | ○ |

TABLE 6B

| Test example | | temperature difference B | power consumption | temperature characteristic & image diagnosis (deposit) −2.8 | −1.2 | 0.6 | 1.4 | 2.2 | 3.4 | 4.5 |
|---|---|---|---|---|---|---|---|---|---|---|
| Embodiment 2 | inner surface heater | 1 | X | X | Δ | Δ | Δ | X | X | X |
| | inner surface heater | 3 | Δ | X | Δ | Δ | Δ | Δ | Δ | X |
| | inner surface heater | 4 | Δ | ○ | ○ | ○ | ○ | ○ | ○ | ○ |
| | external heater B | 6 | ○ | ○ | ○ | ○ | ○ | ○ | ○ | ○ |
| | external heater B | 5 | ○ | Δ | ○ | ○ | ○ | Δ | Δ | X |
| | external heater A | 3 | ○ | Δ | ○ | ○ | ○ | Δ | Δ | X |
| | external heater A | 5 | ○ | Δ | ○ | ○ | ○ | Δ | X | X |
| | external heater A | −5 | X | X | X | X | X | X | X | X |

In the Tables 6A and 6B, regarding the temperature difference B, the temperature of the surface of the photosensitive member and the temperature near the cleaner were measured by a thermocouple. In this case, the temperature difference was represented by a difference in temperature when the temperature of the surface of the photosensitive member reaches [room temperature +10° C.] after the heating is started [(photosensitive member surface temperature increase °C.)—(temperature increase °C. near the photosensitive member)]. In the image diagnosis, high humidity image flow and image defect due to toner fusion were evaluated. Regarding the power consumption, electric power consumed by the heater was evaluated. A symbol ○ indicates "excellent", a symbol Δ indicates "no problem in practical use", and a symbol x indicates "bad".

As a result, by controlling a heat source disposed near the surface of the photosensitive member in such a manner that the temperature dependency at the temperature of 25° to 45° C. (of the surface of the photosensitive member) becomes |0.5%/deg| of the receptive potential and the temperature increase of the surface of the photosensitive member becomes greater than the temperature increase near the photosensitive member, the good results regarding the high humidity image flow and toner deposit could be obtained. Particularly, when an external heater A having a heat generating sintered body provided on an elongated ceramic substrate was used as the heat source, the temperature increase of the cleaner could be suppressed effectively to notable effect.

Similarly, regarding a single copy (one copy) treated by the remodelled copying machine [commercial name: NP-6060 (manufactured by Canon Inc.)], pre-rotation period was set to 10 seconds and time period from start to discharge was set to 15 seconds, and the image was outputted under a condition wherein the heater is energized during only the above periods, in accordance with the conditions in the Embodiment 2.

TABLE 7A

| Test example | | surface increased temperature after copying operation | power consumption | temperature characteristic & image diagnosis (high humidity image flow) −2.8 | −1.2 | 0.6 | 1.4 | 2.2 | 3.4 | 4.5 |
|---|---|---|---|---|---|---|---|---|---|---|
| Embodiment 2 | inner surface layer | +1 | X | ○ | ○ | ○ | ○ | ○ | ○ | ○ |
| | inner surface heater | +0.5 | Δ | Δ | Δ | Δ | Δ | Δ | Δ | Δ |
| | inner surface heater | 0 | Δ | X | X | X | X | X | X | X |
| | external heater B | 0 | ○ | ○ | ○ | ○ | ○ | ○ | ○ | ○ |
| | external heater B | +0.5 | ○ | ○ | ○ | ○ | ○ | ○ | ○ | ○ |
| | external heater A | +1 | ○ | ○ | ○ | ○ | ○ | ○ | ○ | ○ |
| | external heater A | +2 | ○ | ○ | ○ | ○ | ○ | ○ | ○ | ○ |
| | external heater A | +5 | X | ○ | ○ | ○ | ○ | ○ | ○ | ○ |

TABLE 7B

| Test example | | surface increased temperature after copying operation | power consumption | temperature characteristic & image diagnosis (deposit) −2.8 | −1.2 | 0.6 | 1.4 | 2.2 | 3.4 | 4.5 |
|---|---|---|---|---|---|---|---|---|---|---|
| Embodiment 2 | inner surface layer | +1 | X | X | Δ | Δ | Δ | X | X | X |
| | inner surface heater | +0.5 | Δ | X | Δ | Δ | Δ | Δ | Δ | X |
| | inner surface heater | 0 | Δ | ○ | ○ | ○ | ○ | ○ | ○ | ○ |
| | external heater B | 0 | ○ | ○ | ○ | ○ | ○ | ○ | ○ | ○ |
| | external heater B | +0.5 | ○ | Δ | ○ | ○ | ○ | Δ | Δ | X |
| | external heater A | +1 | ○ | Δ | ○ | ○ | ○ | Δ | Δ | X |
| | external heater A | +2 | ○ | Δ | ○ | ○ | ○ | Δ | X | X |
| | external heater A | +5 | X | X | X | X | X | X | X | X |

In the Tables 7A and 7B, in the image diagnosis, high humidity image flow and image defect due to toner deposit caused by the heat from the photosensitive member were evaluated. Regarding the power consumption, electric power consumed by the heater was evaluated. A symbol ○ indicates "excellent", a symbol Δ indicates "no problem in practical use", and a symbol x indicates "bad".

As a result, by controlling a heat source disposed near the surface of the photosensitive member in such a manner that the temperature dependency at the temperature of 25° to 45° C. (of the surface of the photosensitive member) becomes |0.5%/deg| of the receptive potential and the temperature difference between the surface of the photosensitive member (the temperature of which is greater than the temperature of the back surface of the substrate) and the back surface of the substrate has a temperature gradient of 1 to 100 (deg/sec) and the heater is energized only during the image formation, regardless of the very short heating time, the good image without high humidity image flow could be obtained, and the toner deposit was not generated because of the short heating time. This effect was notable particularly when an external heater A having a heat generating sintered body provided on an elongated ceramic substrate was used as the heat source.

Similarly, various photosensitive members wherein the thicknesses of the photo-conductive layers are changed to each other under the conditions shown in Embodiment 2 were manufactured, and, by using the remodelled copying machine [commercial name: NP-6060 (manufactured by Canon Inc.)], the images were outputted while changing a shifting speed of the surface of the photosensitive member (process speed) to evaluate the electric features of various photosensitive members.

TABLE 8A

| Test example | | process speed (mm/sec) | film thickness & image diagnosis (high humidity image flow) (mm) 0.01 | 0.02 | 0.03 | 0.04 | 0.05 | 0.06 | 0.07 |
|---|---|---|---|---|---|---|---|---|---|
| Embodiment 2 | inner surface heater | 200 | ○ | ○ | ○ | ○ | ○ | ○ | ○ |
| | inner surface heater | 300 | ○ | ○ | ○ | ○ | ○ | ○ | ○ |
| | inner surface heater | 400 | ○ | ○ | ○ | ○ | ○ | ○ | ○ |
| | external heater B | 200 | ○ | ○ | ○ | ○ | ○ | ○ | ○ |
| | external heater B | 400 | ○ | ○ | ○ | ○ | ○ | ○ | ○ |
| | external heater A | 200 | ○ | ○ | ○ | ○ | ○ | ○ | ○ |
| | external heater A | 300 | ○ | ○ | ○ | ○ | ○ | ○ | ○ |
| | external heater A | 400 | ○ | ○ | ○ | ○ | ○ | ○ | ○ |

TABLE 8B

| Test example | | process speed (mm/sec) | film thickness & image diagnosis (high humidity image flow) (mm) 0.01 | 0.02 | 0.03 | 0.04 | 0.05 | 0.06 | 0.07 |
|---|---|---|---|---|---|---|---|---|---|
| Embodiment 2 | inner surface heater | 200 | X | Δ | Δ | Δ | Δ | Δ | Δ |
| | inner surface heater | 300 | Δ | Δ | Δ | ○ | ○ | ○ | ○ |
| | inner surface heater | 400 | Δ | Δ | ○ | ○ | ○ | ○ | ○ |
| | external heater B | 200 | Δ | Δ | Δ | Δ | ○ | ○ | ○ |
| | external heater B | 400 | Δ | ○ | ○ | ○ | ○ | ○ | ○ |
| | external heater A | 200 | Δ | Δ | Δ | Δ | ○ | ○ | ○ |
| | external heater A | 300 | Δ | Δ | ○ | ○ | ○ | ○ | ○ |
| | external heater A | 400 | Δ | ○ | ○ | ○ | ○ | ○ | ○ |

TABLE 9A

| Test example | (mm) | film thickness −2.8 | −1.2 | 0.6 | 1.4 | 2.2 | 3.4 | 4.5 |
|---|---|---|---|---|---|---|---|---|
| Embodiment 2 | | temperature characteristic & potential diagnosis (charging ability) | | | | | | |
| inner surface heater | 0.02 | Δ | ○ | ○ | Δ | Δ | Δ | Δ |
| inner surface heater | 0.04 | Δ | ○ | ○ | ○ | Δ | Δ | Δ |
| inner surface heater | 0.06 | Δ | ○ | ○ | ○ | ○ | Δ | Δ |
| external heater B | 0.02 | Δ | ○ | ○ | ○ | Δ | Δ | Δ |
| external heater B | 0.06 | ○ | ○ | ○ | ○ | ○ | Δ | Δ |
| external heater A | 0.02 | Δ | ○ | ○ | ○ | Δ | Δ | Δ |
| external heater A | 0.04 | Δ | ○ | ○ | ○ | ○ | Δ | Δ |
| external heater A | 0.06 | ○ | ○ | ○ | ○ | ○ | Δ | Δ |

TABLE 9B

| Test example | | process speed (mm/sec) | temperature characteristic & potential diagnosis (sensitivity) −2.8 | −1.2 | 0.6 | 1.4 | 2.2 | 3.4 | 4.5 |
|---|---|---|---|---|---|---|---|---|---|
| Embodiment 2 | inner surface heater | 200 | Δ | ○ | ○ | Δ | Δ | Δ | Δ |
| | inner surface heater | 400 | Δ | ○ | ○ | ○ | Δ | Δ | Δ |
| | inner surface heater | 600 | Δ | ○ | ○ | ○ | ○ | Δ | Δ |
| | external heater B | 200 | Δ | ○ | ○ | ○ | Δ | Δ | Δ |
| | external heater B | 600 | ○ | ○ | ○ | ○ | ○ | Δ | Δ |
| | external heater A | 200 | Δ | ○ | ○ | ○ | Δ | Δ | Δ |
| | external heater A | 400 | Δ | ○ | ○ | ○ | ○ | Δ | Δ |
| | external heater A | 600 | ○ | ○ | ○ | ○ | ○ | Δ | Δ |

In the Tables 8A and 8B, in the image diagnosis, high humidity image flow and image defect due to the toner deposit were evaluated, and, in the Tables 9A and 9B, in the electrical feature diagnosis, charging ability (easy to be charged) and sensitivity (easy to be potential-reduced due to exposure) were evaluated. A symbol ○ indicates "excellent", a symbol Δ indicates "no problem in practical use", and a symbol x indicates "bad".

As a result, by controlling a heat source disposed near the surface of the photosensitive member in such a manner that the temperature dependency at the temperature of 25° to 45° C. (of the surface of the photosensitive member) becomes |0.5%/deg| of the receptive potential and the temperature difference between the surface of the photosensitive member (the temperature of which is greater than the temperature of the back surface of the substrate) and the back surface of the substrate has a temperature gradient of 1 to 100 (deg/sec) and the heater is energized only during the image formation, regardless of the very short heating time, the good image without high humidity image flow could be obtained, and the toner deposit was not generated because of the short heating time. This effect was notable particularly when an external heater A having a heat generating sintered body provided on an elongated ceramic substrate was used as the heat source.

Similarly, under the conditions shown in Embodiment 2, by using the remodelled copying machine [commercial name: NP-6060 (manufactured by Canon Inc.)], the images were outputted while changing a ratio (speed ratio) between the shifting speed (process speed) of the surface of the photosensitive member and a roller speed.

TABLE 10A

| Test example | | speed ratio (%) | temperature characteristic & image diagnosis (high humidity image flow) −2.8 | −1.2 | 0.6 | 1.4 | 2.2 | 3.4 | 4.5 |
|---|---|---|---|---|---|---|---|---|---|
| Embodiment 2 | inner surface heater | 100 | Δ | Δ | Δ | Δ | Δ | Δ | Δ |
| | inner surface heater | 110 | ○ | ○ | ○ | ○ | ○ | ○ | ○ |
| | inner surface heater | 120 | ○ | ○ | ○ | ○ | ○ | ○ | ○ |
| | external heater B | 100 | Δ | Δ | Δ | Δ | Δ | Δ | Δ |
| | external heater B | 120 | ○ | ○ | ○ | ○ | ○ | ○ | ○ |
| | external heater A | 100 | Δ | Δ | Δ | Δ | Δ | Δ | Δ |
| | external heater A | 110 | ○ | ○ | ○ | ○ | ○ | ○ | ○ |
| | external heater A | 120 | ○ | ○ | ○ | ○ | ○ | ○ | ○ |

TABLE 10B

| Test example | | speed ratio (%) | temperature characteristic & image diagnosis (deposit) −2.8 | −1.2 | 0.6 | 1.4 | 2.2 | 3.4 | 4.5 |
|---|---|---|---|---|---|---|---|---|---|
| Embodiment 2 | inner surface heater | 100 | X | X | X | X | X | X | X |
| | inner surface heater | 110 | Δ | Δ | Δ | Δ | Δ | Δ | Δ |
| | inner surface heater | 120 | Δ | Δ | Δ | Δ | Δ | Δ | Δ |
| | external heater B | 100 | Δ | Δ | Δ | Δ | Δ | Δ | Δ |
| | external heater B | 120 | Δ | Δ | Δ | Δ | Δ | Δ | Δ |
| | external heater A | 100 | Δ | Δ | Δ | Δ | Δ | Δ | Δ |
| | external heater A | 110 | ○ | ○ | ○ | ○ | ○ | ○ | ○ |
| | external heater A | 120 | ○ | ○ | ○ | ○ | ○ | ○ | ○ |

TABLE 10C

| Test example | | speed ratio (%) | temperature characteristic & image diagnosis (insulation breakage) −2.8 | −1.2 | 0.6 | 1.4 | 2.2 | 3.4 | 4.5 |
|---|---|---|---|---|---|---|---|---|---|
| Embodiment 2 | inner surface heater | 300 | ○ | ○ | ○ | ○ | ○ | ○ | ○ |
| | inner surface heater | 400 | Δ | Δ | Δ | Δ | Δ | Δ | Δ |
| | inner surface heater | 500 | X | X | X | X | X | X | X |
| | external heater B | 300 | ○ | ○ | ○ | ○ | ○ | ○ | ○ |
| | external heater B | 500 | X | X | X | X | X | X | X |
| | external heater A | 300 | ○ | ○ | ○ | ○ | ○ | ○ | ○ |
| | external heater A | 400 | Δ | Δ | Δ | Δ | Δ | Δ | Δ |
| | external heater A | 120 | ○ | ○ | ○ | ○ | ○ | ○ | ○ |

In the Tables 10A–10C, in the image diagnosis, high humidity image flow, image defect due to the toner deposit, and image defect due to insulation breakage of the photosensitive member caused by charge-up toner were evaluated. A symbol ○ indicates "excellent", a symbol Δ indicates "no problem in practical use", and a symbol x indicates "bad".

As a result, by controlling a heat source disposed near the surface of the photosensitive member in such a manner that the temperature dependency at the temperature of 25° to 45° C. (of the surface of the photosensitive member) becomes |0.5%/deg| of the receptive potential and the temperature difference between the surface of the photosensitive member (the temperature of which is greater than the temperature of the back surface of the substrate) and the back surface of the substrate has a temperature gradient of 1 to 100 (deg/sec) and the heater is energized only during the image formation, the good results providing no high humidity image flow, no toner deposit and no insulation breakage could be obtained. These effects were notable particularly when an external heater A having a heat generating sintered body provided on an elongated ceramic substrate was used as the heat source.

Similarly, various photosensitive members wherein heights of protrusions with respect to an average surface of the photosensitive member are changed to each other under the conditions shown in Embodiment 2 were manufactured, and, by using the remodelled copying machine [commercial name: NP-6060 (manufactured by Canon Inc.)], the images were outputted regarding the above-mentioned various photosensitive members.

TABLE 11A

| Test example | | height of protrusion (mm) | temperature characteristic & image diagnosis (high humidity image flow) −2.8 | −1.2 | 0.6 | 1.4 | 2.2 | 3.4 | 4.5 |
|---|---|---|---|---|---|---|---|---|---|
| Embodiment 2 | inner surface heater | 0.005 | ○ | ○ | ○ | ○ | ○ | ○ | ○ |
| | inner surface heater | 0.01 | ○ | ○ | ○ | ○ | ○ | ○ | ○ |
| | inner surface heater | 0.015 | ○ | ○ | ○ | ○ | ○ | ○ | ○ |
| | external heater B | 0.005 | ○ | ○ | ○ | ○ | ○ | ○ | ○ |
| | external heater B | 0.015 | ○ | ○ | ○ | ○ | ○ | ○ | ○ |
| | external heater A | 0.005 | ○ | ○ | ○ | ○ | ○ | ○ | ○ |
| | external heater A | 0.01 | ○ | ○ | ○ | ○ | ○ | ○ | ○ |
| | external heater A | 0.015 | ○ | ○ | ○ | ○ | ○ | ○ | ○ |

TABLE 11B

| Test example | | height of protrusion (mm) | temperature characteristic & image diagnosis (deposit) −2.8 | −1.2 | 0.6 | 1.4 | 2.2 | 3.4 | 4.5 |
|---|---|---|---|---|---|---|---|---|---|
| Embodiment 2 | inner surface heater | 0.005 | Δ | Δ | Δ | Δ | Δ | Δ | Δ |
| | inner surface heater | 0.01 | Δ | Δ | Δ | Δ | Δ | Δ | Δ |
| | inner surface heater | 0.015 | X | X | X | X | X | X | X |
| | external heater B | 0.005 | ○ | ○ | ○ | ○ | ○ | ○ | ○ |
| | external heater B | 0.015 | Δ | Δ | Δ | Δ | Δ | Δ | Δ |
| | external heater A | 0.005 | ○ | ○ | ○ | ○ | ○ | ○ | ○ |
| | external heater A | 0.01 | ○ | ○ | ○ | ○ | ○ | ○ | ○ |
| | external heater A | 0.015 | Δ | Δ | Δ | Δ | Δ | Δ | Δ |

In the Tables 11A and 11B, in the image diagnosis, high humidity image flow and image defect due to the toner deposit were evaluated. A symbol ○ indicates "excellent", a symbol Δ indicates "no problem in practical use", and a symbol x indicates "bad".

As a result, by controlling a heat source disposed near the surface of the photosensitive member in such a manner that the temperature dependency at the temperature of 25° to 45° C. (of the surface of the photosensitive member) becomes |0.5%/deg| of the receptive potential and the temperature difference between the surface of the photosensitive member (the temperature of which is greater than the temperature of the back surface of the substrate) and the back surface of the substrate has a temperature gradient of 1 to 100 (deg/sec) and the heater is energized only during the image formation, the good results providing no high humidity image flow and no toner deposit could be obtained. These effects were notable particularly when an external heater A having a heat generating sintered body provided on an elongated ceramic substrate was used as the heat source.

Similarly, under the conditions shown in Embodiment 2, various photosensitive members wherein the insulation breakage voltages with respect to the polarity opposite to the charging polarity of the photosensitive member were manufactured, and, by using the remodelled copying machine [commercial name: NP-6060 (manufactured by Canon Inc.)], the images were outputted regarding the above-mentioned various photosensitive members.

TABLE 12A

| Test example | | insulation breakage voltage (V) | temperature characteristic & image diagnosis (high humidity image flow) −2.8 | −1.2 | 0.6 | 1.4 | 2.2 | 3.4 | 4.5 |
|---|---|---|---|---|---|---|---|---|---|
| Embodiment 2 | inner surface heater | 300 | ○ | ○ | ○ | ○ | ○ | ○ | ○ |
| | inner surface heater | 500 | ○ | ○ | ○ | ○ | ○ | ○ | ○ |
| | inner surface heater | 700 | ○ | ○ | ○ | ○ | ○ | ○ | ○ |
| | external heater B | 300 | ○ | ○ | ○ | ○ | ○ | ○ | ○ |
| | external heater B | 700 | ○ | ○ | ○ | ○ | ○ | ○ | ○ |
| | external heater A | 300 | ○ | ○ | ○ | ○ | ○ | ○ | ○ |
| | external heater A | 500 | ○ | ○ | ○ | ○ | ○ | ○ | ○ |
| | external heater A | 700 | ○ | ○ | ○ | ○ | ○ | ○ | ○ |

TABLE 12B

| Test example | | insulation breakage voltage (V) | temperature characteristic & image diagnosis (insulation breakage) −2.8 | −1.2 | 0.6 | 1.4 | 2.2 | 3.4 | 4.5 |
|---|---|---|---|---|---|---|---|---|---|
| Embodiment 2 | inner surface heater | 300 | Δ | Δ | Δ | Δ | Δ | Δ | Δ |
| | inner surface heater | 500 | ○ | ○ | ○ | ○ | ○ | ○ | ○ |
| | inner surface heater | 700 | ○ | ○ | ○ | ○ | ○ | ○ | ○ |
| | external heater B | 300 | Δ | Δ | Δ | Δ | Δ | Δ | Δ |
| | external heater B | 700 | ○ | ○ | ○ | ○ | ○ | ○ | ○ |
| | external heater A | 300 | Δ | Δ | Δ | Δ | Δ | Δ | Δ |
| | external heater A | 500 | ○ | ○ | ○ | ○ | ○ | ○ | ○ |
| | external heater A | 700 | ○ | ○ | ○ | ○ | ○ | ○ | ○ |

In the Tables 12A and 12B, in the image diagnosis, high humidity image flow and image defect due to insulation breakage of the photosensitive member caused by charge-up toner were evaluated. A symbol ○ indicates "excellent", a symbol Δ indicates "no problem in practical use", and a symbol x indicates "bad".

As a result, by controlling a heat source disposed near the surface of the photosensitive member in such a manner that the temperature dependency at the temperature of 25° to 45° C. (of the surface of the photosensitive member) becomes |0.5%/deg| of the receptive potential and the temperature difference between the surface of the photosensitive member (the temperature of which is greater than the temperature of the back surface of the substrate) and the back surface of the substrate has a temperature gradient of 1 to 100 (deg/sec) and the heater is energized only during the image formation, the good results providing no high humidity image flow and no toner deposit could be obtained. These effects were notable particularly when an external heater A having a heat generating sintered body provided on an elongated ceramic substrate was used as the heat source.

<Embodiment 3>

The photosensitive member was formed by using the manufacturing apparatus for manufacturing the electrophotographic photosensitive member shown in FIG. 2 in accordance with a forming condition shown in a Table 13.

In this case, Eu and D.O.S of the photo-conductive layer were 55 meV and $2\times10^{15}$ $cm^{-3}$, respectively, and, the temperature characteristic was 1.1 V/deg. The photosensitive member was heated by means of the external heater A in such a manner that the temperature difference between the surface of the photosensitive member (the temperature of which is greater than the temperature of the back surface of the substrate) and the back surface of the substrate has a temperature gradient of 1.5 (deg/sec), and evaluation similar to Embodiment 2 was effected. As a result, as is in Embodiment 2, good electrophotographic feature could be obtained.

<Embodiment 4>

The photosensitive member was formed by using the manufacturing apparatus for manufacturing the electrophotographic photosensitive member shown in FIG. 2 in accordance with a forming condition shown in a Table 14. In this case, Eu and D.O.S of the photo-conductive layer were 50 meV and $8\times10^{14}$ $cm^{-3}$, respectively, and, the temperature characteristic was 0.5 V/deg. The photosensitive member was heated by means of the external heater A in such a manner that the temperature of the surface of the photosensitive member is greater than the temperature of the back surface of the substrate by 2° C., and evaluation similar to Embodiment 2 was effected. As a result, as is in Embodiment 2, good electrophotographic feature could be obtained.

TABLE 13

| | charge injection preventing layer | photo-conductive layer | intermediate layer | surface layer |
|---|---|---|---|---|
| gas kind & flow rate | | | | |
| $SiH_4$ [SCCM] | 150 | 200 | 100 | 10 |
| $H_2$ [SCCM] | 500 | 800 | | |
| $PH_3$ [PPM] (for $SiH_4$) | 1000 | | | |
| $B_2H_6$ [PPM] (for $SiH_4$) | | 0.5 | 500 | |
| $CH_4$ [SCCM] | 20 | | 300 | 500 |
| support temterature [°C.] | 290 | 250 | 250 | 250 |
| inner pressure [Torr] | 0.3 | 0.3 | 0.2 | 0.1 |
| Power [W] | 300 | 600 | 300 | 200 |
| film thickness [μm] | 2 | 30 | 0.1 | 0.5 |

TABLE 14

| | charge injection preventing layer | photo-conductive layer | surface layer |
|---|---|---|---|
| gas kind & flow rate | | | |
| $SiH_4$ [SCCM] | 150 | 200 | 200 → 10 → 10 |
| $SiF_4$ [SCCM] | 2 | 1 | 5 |
| $H_2$ [SCCM] | 500 | 1000 | |
| $B_2H_6$ [PPM] (for $SiH_4$) | 1500 | 2 | 10 |
| NO [SCCM] | 10 | 1 | 3 |
| $CH_4$ [SCCM] | 5 | 1 | 50 → 600 → 700 |
| support temperature [°C.] | 270 | 260 | 250 |
| inner pressure [Torr] | 0.1 | 0.3 | 0.5 |
| Power [W] | 200 | 600 | 100 |
| film thickness [μm] | 2 | 30 | 0.5 |

<Embodiment 5>

The photosensitive member was formed by using the manufacturing apparatus for manufacturing the electrophotographic photosensitive member shown in FIG. 2 in accordance with a forming condition shown in a Table 15. In this case, Eu and D.O.S of the photo-conductive layer were 60 meV and $5\times10^{15}$ $cm^{-3}$, respectively, and, the temperature characteristic was 0.8 V/deg. The photosensitive member was heated by means of the external heater A in such a manner that the temperature increasing difference between the surface of the photosensitive member (the temperature of which is greater than the proximity of the photosensitive member) and the proximity of the photosensitive member is 3° C., and evaluation similar to Embodiment 2 was effected. As a result, as is in Embodiment 2, the blocking of the waste toner was eliminated and good electrophotographic feature could be obtained.

TABLE 15

| | IR absorption layer | charge injection preventing layer | photo-conductive layer | surface layer |
|---|---|---|---|---|
| gas kind & flow rate | | | | |
| $SiH_4$ [SCCM] | 150 | 150 | 150 | 150 → 15 → 10 |
| $GeH_4$ [SCCM] | 50 | | | |
| $H_2$ [SCCM] | 500 | 500 | 800 | |
| $B_2H_6$ [PPM] (for $SiH_4$) | 3000 | 2000 | 1 | |
| NO [SCCM] | 15 → 10 | 10 | | 5 |
| $CH_4$ [SCCM] | | | | 0 → 500 → 600 |
| support temterature [°C.] | 250 | 250 | 280 | 250 |
| inner pressure [Torr] | 0.3 | 0.3 | 0.5 | 0.5 |
| Power [W] | 100 | 200 | 600 | 100 |
| film thickness [μm] | 1 | 2 | 25 | 0.5 |

As mentioned above, according to the present invention, different from the conventional system wherein moisture is removed at a relatively low temperature avoiding degeneration of the photosensitive member for a long time with relatively low electric power, by utilizing a system obtained by combination of the re-usable toner, the improved heater and the improved photosensitive member, i.e. a moisture removing system of the electrophotographing apparatus wherein a very high temperature is applied to the photosensitive member for a short time, the excellent image stabilization can be achieved in the toner re-using system.

Further, according to the present invention, it is possible to eliminate the various drawbacks caused by the conventional electrophotographic photosensitive members constituted by OPC and a—Si, and the excellent electrical feature, optical feature, photo-conductive feature, image feature, durability and usage environmental feature can be achieved.

Particularly, in the present invention, by constituting the photo-conductive layer by a—Si with sufficient reduction of the level in the gap, since the change in surface potential with respect to the change in the surrounding environmental condition can be suppressed and optical fatigue and light memory can be reduced to a negligible extent, excellent potential feature and image feature can be achieved.

Further, according to the present invention, by constituting the electrophotographic photosensitive member by a—Si with increased thickness and by increasing the shifting speed of the surface of the photosensitive member, the temperature increase of the photosensitive member can be suppressed and the potential feature having excellent charging ability and photo-sensitivity can be obtained.

What is claimed is:

1. An electrophotographing apparatus comprising:

a photosensitive member capable of bearing toner thereon, wherein when the thickness of said photosensitive member is d and measured in millimeters and the shifting speed of the surface of said photosensitive member is v and measured in millimeters per second, the relation $d\times v\geqq 9$ is satisfied, and wherein the shifting speed of the surface of said photosensitive member is at least 300 millimeters per second;

latent image forming means for forming a latent image on said photosensitive member;

developing means for developing the latent image with toner as a toner image;

transfer means for transferring the toner image formed on said photosensitive member onto a transfer material at a transfer position;

collection means for collecting the toner from a surface of said photosensitive member after said surface passes through said transfer position, said collection means including a rotary member rotated while contacting the surface of said photosensitive member at a contact position, and said rotary member being rotated in a direction opposite to a shifting direction of said photosensitive member at said contact position in such a manner that the relative speed of said rotary member with respect to the surface of said photosensitive member at said contact position becomes 110% or more of the shifting speed of the surface of said photosensitive member; and toner convey means for conveying the toner collected by said collection means to said developing means so that the latent image formed on said photosensitive member can be developed by the toner collected by said collection means.

2. An electrophotographing apparatus according to claim 1, wherein at least one protrusion is formed on the surface of said photosensitive member, and a maximum height of said protrusion with respect to a surface level of said photosensitive member except for said protrusion is 0.01 (mm) or less.

3. An electrophotographing apparatus according to claim 2, wherein the average particle diameter of the toner is 0.004 to 0.011 (mm).

4. An electrophotographing apparatus according to claim 3, wherein the absolute value of the temperature dependency of the receptive potential of said photosensitive member at a temperature of 25° to 45° C. is 0.5 (%/deg) or less.

5. An electrophotographing apparatus according to claim 4, further comprising a conductive support for supporting said photosensitive member and a heat source disposed in the proximity of the surface of said photosensitive member, and wherein said heat source heats said photosensitive member with a temperature gradient of 1 to 100 (deg/sec) so that the temperature of the surface of said photosensitive member becomes greater than the temperature of a back surface of said conductive support.

6. An electrophotographing apparatus according to claim 1, wherein, when a voltage having a polarity opposite to a charging polarity of said photosensitive member is applied to the surface of said photosensitive member, the absolute value of said voltage causing insulation breakage of said photosensitive member is 500 (V) or more.

7. An electrophotographing apparatus according to claim 1, wherein said rotary member is rotated in the direction opposite to the shifting direction of the surface of said photosensitive member at said contact position in such a manner that the relative speed between said rotary member and the surface of said photosensitive member becomes 400% or more of the shifting speed of the surface of said photosensitive member.

8. An electrophotographing apparatus according to claim 1, wherein the absolute value of temperature dependency of receptive potential of said photosensitive member at a temperature of 25° to 45° C. is 0.5 (%/deg) or less.

9. An electrophotographing apparatus according to claim 8, further comprising a conductive support for supporting said photosensitive member and a heat source disposed in the proximity of the surface of said photosensitive member, and wherein said heat source heats said photosensitive member with a temperature gradient of 1 to 100 (deg/sec) so that one temperature of the surface of said photosensitive member becomes greater than the temperature of a back surface of said conductive support.

10. An electrophotographing apparatus according to claim 9, wherein said heat source comprises a ceramic substrate, and a heat generating sintered body provided on said ceramic substrate.

11. An electrophotographing apparatus according to claim 9, wherein the temperature increase of the surface of said photosensitive member is greater than the temperature increase of the back surface of said conductive support.

12. An electrophotographing apparatus according to claim 9, wherein the temperature increase of the surface of said photosensitive member is greater than the temperature increase of air in the proximity of the surface of said photosensitive member.

13. An electrophotographing apparatus according to any one of claims 1 and 2 to 5, wherein said photosensitive member has a photo-conductive layer providing photo-conductivity and is made of a noncrystalline material including silicon atoms as a base component and including hydrogen atoms and/or halogen atoms, and wherein said photo-conductive layer includes the hydrogen atoms and/or halogen atoms of 10 to 30 atomic %, and wherein in said photo-conductive layer, feature energy of an exponential function tail, obtained from a sub band gap light absorption spectrum at least a portion to which light is incident, is 50 to 60 (meV) and a local level density, at a conduction band lower end of 0.45 to 0.95 (eV), is $1\times10^{14}$ to $5\times10^{15}$ ($cm^{-3}$)

14. An electrophotographing apparatus comprising:

a photosensitive member capable of bearing toner thereon, in which the absolute value of the temperature dependency of the receptive potential of said photosensitive member at a temperature of 25° to 45° C. is 0.5 (%/deg) or less;

latent image forming means for forming a latent image on said photosensitive member;

developing means for developing the latent image with toner as a toner image;

transfer means for transferring the toner image formed on said photosensitive member onto a transfer material at a transfer position;

collection means for collecting the toner from a surface of said photosensitive member after said surface passes through said transfer position;

toner convey means for conveying the toner collected by said collection means to said developing means; and a heat source disposed in the proximity of the surface of said photosensitive member and adapted to heat said photosensitive member with a temperature gradient of 1 to 100 (deg/sec).

15. An electrophotographing apparatus according to claim 14, wherein said heat source comprises a ceramic substrate, and a heat generating sintered body provided on said ceramic substrate.

16. An electrophotographing apparatus according to claim 15, wherein the temperature increase of the surface of said photosensitive member is greater than the temperature increase of the back surface of said conductive support.

17. An electrophotographing apparatus according to claim 15, wherein the temperature increase of the surface of said photosensitive member is greater than the temperature increase of air in the proximity of the surface of said photosensitive member.

18. An electrophotographing apparatus according to any one of claim 14 to 17, wherein said photosensitive member has a photo-conductive layer providing photo-conductivity and is made of a noncrystalline material including silicon atoms as a base component and including hydrogen atoms and/or halogen atoms, and wherein said photo-conductive layer includes the hydrogen atoms and/or halogen atoms of 10 to 30 atomic %, and wherein in said photo-conductive layer, feature energy of an exponential function tail, obtained from a sub band gap light absorption spectrum at least a portion to which light is incident, is 50 to 60 (meV), and a local level density, at a conduction band lower end of 0.45 to 0.95 (eV), is $1\times10^{14}$ to $5\times10^{15}$ ($cm^{-3}$).

* * * * *

UNITED STATES PATENT AND TRADEMARK OFFICE

CERTIFICATE OF CORRECTION

PATENT NO. : 5,689,768

DATED : November 18, 1997

INVENTOR(S) : Ehara et al.

It is certified that error appears in the above-indentified patent and that said Letters Patent is hereby corrected as shown below:

In the title page:

Item [56] References Cited:

U.S. PATENT DOCUMENTS

Change

| | | | |
|---|---|---|---|
| 3,879,124 | 04/1975 | Eppe et al. | 355/298 X |
| 3,917,397 | 11/1975 | Tanaka et al. | 355/297 |
| 4,265,991 | 05/1981 | Hirai et al. | 430/64 |
| 4,721,663 | 01/1988 | Johncock et al. | 430/66 X |
| 4,755,853 | 07/1988 | Shimizu et al. | 355/298 |
| 4,939,057 | 07/1990 | Honda et al. | 430/69 |
| 5,289,249 | 02/1994 | Yamamoto et al. | 355/298 |
| 5,400,127 | 03/1995 | Arai et al. | 355/298 |
| 5,442,430 | 08/1995 | Ishii et al. | 355/298 |
| 5,561,021 | 10/1996 | Yamazaki et al. | 430/66 X |

To

| | | | |
|---|---|---|---|
| 2,297,691 | 10/1942 | Carlson | 430/55 |
| 3,879,124 | 04/1975 | Eppe et al. | 355/298 X |
| 3,917,397 | 11/1975 | Tanaka et al. | 355/297 |
| 4,265,991 | 05/1981 | Hirai et al. | 430/64 |
| 4,721,663 | 01/1988 | Johncock et al. | 430/66 X |
| 4,755,853 | 07/1988 | Shimizu et al. | 355/298 |
| 4,939,057 | 07/1990 | Honda et al. | 430/69 |
| 4,952,978 | 08/1990 | Ueda et al. | 355/245 |
| 5,289,249 | 02/1994 | Yamamoto et al. | 355/298 |
| 5,400,127 | 03/1995 | Arai et al. | 355/298 |
| 5,442,430 | 08/1995 | Ishii et al. | 355/298 |
| 5,561,021 | 10/1996 | Yamazaki et al. | 430/66 X |

UNITED STATES PATENT AND TRADEMARK OFFICE

CERTIFICATE OF CORRECTION

PATENT NO. : 5,689,768

DATED : November 18, 1997

INVENTOR(S) : Ehara et al.

It is certified that error appears in the above-indentified patent and that said Letters Patent is hereby corrected as shown below:

Insert:

FOREIGN PATENT DOCUMENTS

| | | |
|---|---|---|
| 42-23910 | 11/1942 | Japan |
| 43-24748 | 10/1943 | Japan |
| 57-158650 | 09/1982 | Japan |
| 59-111179 | 06/1984 | Japan |
| 60-35059 | 08/1985 | Japan |
| 60-67951 | 04/1985 | Japan |
| 60-95551 | 05/1985 | Japan |
| 60-168156 | 08/1985 | Japan |
| 60-178457 | 09/1985 | Japan |
| 60-225854 | 11/1985 | Japan |
| 61-100780 | 05/1986 | Japan |
| 61-231561 | 10/1986 | Japan |
| 62-168161 | 07/1987 | Japan |
| 62-278577 | 12/1987 | Japan |
| 2-38956 | 09/1990 | Japan |

COLUMN 5:

Line 45, "hand" should read --hand,--.

COLUMN 6:

Line 25, "one" should read --the--.

COLUMN 13:

Line 29, "tall)" should read --tail)--.

UNITED STATES PATENT AND TRADEMARK OFFICE

CERTIFICATE OF CORRECTION

PATENT NO. : 5,689,768

DATED : November 18, 1997

INVENTOR(S) : Ehara et al.

It is certified that error appears in the above-indentified patent and that said Letters Patent is hereby corrected as shown below:

COLUMN 16:

Line 31, "like. Since" should read --like, since--.

COLUMN 17:

Line 67, "$INCl_3$," should read --$InCl_3$,--.

COLUMN 20:

Line 16, "atoms)" should read --atoms--; and
Line 19, "of" (second occurrence) should read --of the--.

COLUMN 26:

Line 55, "by" should be deleted.

COLUMN 28:

Line 24, "be." should read --be--.

COLUMN 30:

Line 19, "later)," should read --later,--.

COLUMN 37:

Line 59, "|room" should read --room--; and
Line 60, "+10°C.|" should read --+10°C.--

UNITED STATES PATENT AND TRADEMARK OFFICE

CERTIFICATE OF CORRECTION

PATENT NO. : 5,689,768

DATED : November 18, 1997

INVENTOR(S) : Ehara et al.

It is certified that error appears in the above-indentified patent and that said Letters Patent is hereby corrected as shown below:

COLUMN 39:

Line 58, "|room temperature +10°C|" should read --room temperature +10°C--.

COLUMN 41:

Table 7A, "layer" should read --heater--; and
Table 7B, "layer" should read --heater--.

COLUMN 43:

Table 9A, "

| | film thickness | | | temperature characteristic & potential diagnosis (charging ability) | | | |
|---|---|---|---|---|---|---|---|
| (mm) | -2.8 | -1.2 | 0.6 | 1.4 | 2.2 | 3.4 | 4.5 |

"

should read

--

| film thickness (mm) | temperature characteristic & potential diagnosis (charging ability) | | | | | | |
|---|---|---|---|---|---|---|---|
| | -2.8 | -1.2 | 0.6 | 1.4 | 2.2 | 3.4 | 4.5 |

--.

UNITED STATES PATENT AND TRADEMARK OFFICE

CERTIFICATE OF CORRECTION

PATENT NO. : 5,689,768

DATED : November 18, 1997

INVENTOR(S) : Ehara et al.

It is certified that error appears in the above-indentified patent and that said Letters Patent is hereby corrected as shown below:

COLUMN 45:

Table 10C, "120" should read --500--.

COLUMN 54:

Line 12, at the end of the, add a -- . -- (period);
Line 13, "." should be deleted; and
Line 51, "claim 14 to 17" should read --claims 14 to 17,--.

Insert:

Signed and Sealed this

Twelfth Day of January, 1999

*Attest:*

*Attesting Officer*

*Acting Commissioner of Patents and Trademarks*